US010590721B2

(12) United States Patent
Johnson et al.

(10) Patent No.: US 10,590,721 B2
(45) Date of Patent: Mar. 17, 2020

(54) DUAL GRADIENT DRILLING SYSTEM AND METHOD

(71) Applicant: AMERIFORGE GROUP INC., Houston, TX (US)

(72) Inventors: Austin Johnson, Houston, TX (US); Brian Piccolo, Houston, TX (US); Justin Fraczek, Houston, TX (US); Waybourn Anderson, Houston, TX (US); Christian Leuchtenberg, Singapore (SG)

(73) Assignee: AMERIFORGE GROUP INC., Houston, TX (US)

( * ) Notice: Subject to any disclaimer, the term of this patent is extended or adjusted under 35 U.S.C. 154(b) by 0 days.

(21) Appl. No.: 16/249,186

(22) Filed: Jan. 16, 2019

(65) Prior Publication Data

US 2019/0145205 A1 May 16, 2019

Related U.S. Application Data

(63) Continuation of application No. PCT/US2018/036968, filed on Jun. 11, 2018.
(Continued)

(51) Int. Cl.
*E21B 21/08* (2006.01)
*E21B 33/064* (2006.01)
(Continued)

(52) U.S. Cl.
CPC ..... *E21B 21/08* (2013.01); *E21B 17/01* (2013.01); *E21B 21/001* (2013.01);
(Continued)

(58) Field of Classification Search
CPC ..... E21B 21/08; E21B 21/067; E21B 21/106; E21B 17/01; E21B 33/06; E21B 33/064; E21B 43/129
See application file for complete search history.

(56) References Cited

U.S. PATENT DOCUMENTS 4,063,602 A * 12/1977 Howell ..... E21B 7/128 175/7
4,291,772 A * 9/1981 Beynet ..... E21B 21/08 175/25
(Continued)

FOREIGN PATENT DOCUMENTS

EP 1144800 A1 10/2001
GB 2501094 A 10/2013
(Continued)

OTHER PUBLICATIONS

Claire Cole, Double Acting Diaphragm Pumps Save Space, www.EngineerLive.com, retrieved from URL https://www.engineerlive.com/content/double-acting-diaphragm-pumps-save-space on Sep. 2, 2018, published Jul. 10, 2013.
(Continued)

*Primary Examiner* — Matthew R Buck
*Assistant Examiner* — Aaron L Lembo
(74) *Attorney, Agent, or Firm* — Basil M. Angelo; Angelo IP

(57) ABSTRACT

A dual gradient drilling system includes a subsea blowout preventer disposed above a wellhead, the subsea blowout preventer having a central lumen configured to provide access to a wellbore, a lower section of a marine riser fluidly connected to the subsea blowout preventer, a closed-hydraulic positive displacement subsea pump system fluidly connected to the lower section of the marine riser and disposed at a predetermined depth, an annular sealing system disposed above the closed-hydraulic positive displacement subsea pump system, and an independent mud return line fluidly connecting one or more pump heads of the closed-hydraulic positive displacement subsea pump system to a choke manifold disposed on a floating platform of a rig.

14 Claims, 15 Drawing Sheets

Related U.S. Application Data

(60) Provisional application No. 62/517,992, filed on Jun. 12, 2017, provisional application No. 62/560,153, filed on Sep. 18, 2017.

(51) Int. Cl.

| | |
|---|---|
| ***E21B 43/12*** | (2006.01) |
| ***E21B 17/01*** | (2006.01) |
| ***E21B 33/06*** | (2006.01) |
| ***E21B 21/00*** | (2006.01) |
| ***E21B 21/06*** | (2006.01) |
| ***E21B 21/10*** | (2006.01) |

(52) U.S. Cl.

CPC ..... *E21B 21/067* (2013.01); *E21B 21/106* (2013.01); *E21B 33/06* (2013.01); *E21B 33/064* (2013.01); *E21B 43/129* (2013.01)

(56) References Cited

U.S. PATENT DOCUMENTS

| | | | | |
|---|---|---|---|---|
| 6,102,673 | A * | 8/2000 | Mott | E21B 21/001 137/596.17 |
| 6,415,877 | B1 | 7/2002 | Fincher et al. | |
| 6,454,022 | B1 * | 9/2002 | Sangesland | E21B 21/08 175/7 |
| 6,561,774 | B2 | 5/2003 | Layman | |
| 6,966,367 | B2 * | 11/2005 | Butler | E21B 21/001 166/105 |
| 7,270,185 | B2 | 9/2007 | Fontana et al. | |
| 7,584,801 | B2 | 9/2009 | deBoer | |
| 7,866,399 | B2 * | 1/2011 | Kozicz | E21B 17/01 166/367 |
| 7,913,764 | B2 * | 3/2011 | Smith | E21B 21/001 166/358 |
| 7,938,201 | B2 * | 5/2011 | Giroux | E21B 21/001 166/208 |
| 8,066,079 | B2 | 11/2011 | Boer | |
| 8,162,063 | B2 | 4/2012 | Humphreys | |
| 8,517,111 | B2 | 8/2013 | Mix et al. | |
| 8,783,379 | B2 | 7/2014 | Stave | |
| 8,845,298 | B2 | 9/2014 | Larsen et al. | |
| 8,863,849 | B2 | 10/2014 | Patel | |
| 8,967,292 | B2 * | 3/2015 | Hammersmark | E21B 7/20 166/358 |
| 8,978,774 | B2 * | 3/2015 | Fossli | E21B 21/001 166/347 |
| 9,062,498 | B2 * | 6/2015 | Potter | E21B 7/128 |
| 9,068,420 | B2 | 6/2015 | Rajabi et al. | |
| 9,249,637 | B2 | 2/2016 | Springett et al. | |
| 9,316,054 | B2 | 4/2016 | Weinstock et al. | |
| 9,322,230 | B2 | 4/2016 | Talamo et al. | |
| 9,428,975 | B2 * | 8/2016 | Stave | E21B 17/01 |
| 9,963,947 | B2 * | 5/2018 | Kjosnes | E21B 33/085 |
| 2001/0050185 | A1 * | 12/2001 | Calder | E21B 21/001 175/5 |
| 2003/0066650 | A1 | 4/2003 | Fontana et al. | |
| 2011/0278014 | A1 | 11/2011 | Hughes et al. | |
| 2013/0206423 | A1 | 8/2013 | Weinstock et al. | |
| 2015/0275602 | A1 | 10/2015 | Kjøsnes et al. | |
| 2016/0168934 | A1 | 6/2016 | Weinstock et al. | |
| 2018/0038177 | A1 | 2/2018 | Leuchtenberg | |

FOREIGN PATENT DOCUMENTS

| | | | |
|---|---|---|---|
| WO | 0039431 | A1 | 7/2000 |
| WO | 2009123476 | A1 | 10/2009 |
| WO | 2013055226 | A1 | 4/2013 |
| WO | 2013115651 | A2 | 8/2013 |
| WO | 2013184866 | A2 | 12/2013 |
| WO | 2014049369 | A3 | 4/2015 |
| WO | 2016135480 | A1 | 9/2016 |

OTHER PUBLICATIONS

Don Francis, Advances in Dual Gradient Drilling Will Facilitate Deepwater Development, www.Offshore-Mag.com, retrieved from URL https://www.offshore-mag.com/articles/print/volume-74/issue-3/drilling-and-completion/advances-in-dual-gradient-drilling-will-facilitate-deepwater-development.html on Sep. 4, 2018, published Mar. 10, 2014.

Enhanced Drilling, EC-Drill Managed Pressure Drilling System, retrieved from https://www.youtube.com/watch?v=oDwjBLjfiqU on Sep. 4, 2018, video published to www.YouTube.com on Jun. 3, 2015.

International Search Report of the International Search Authority (USPTO) for PCT International Application No. PCT/US2018/036968, filed on Jun. 11, 2018, dated Aug. 21, 2018.

J.C. Eggemeyer, M.E. Akins, R.R. Brainard, R.A. Judge, C.P. Peterman, L.J. Scavone, and K.S. Thethi, Subsea Mudlift Drilling: Design and Implementation of a Dual Gradient Drilling System, Society of Petroleum Engineers, Presented at SPE Annual Technical Conference and Exhibition, Sep. 30-Oct. 3, New Orleans, Louisiana, SPE 71359, 2001.

J.P. Schumacher, J.D. Dowell, L.R. Ribbeck, and J.C. Eggemeyer, Subsea Mudlift Drilling: Planning and Preparation for the First Subsea Field Test of a Full-Scale Dual Gradient Drilling System at Green Canyon 136, Gulf of Mexico, Society of Petroleum Engineers, Presented at SPE Annual Technical Conference and Exhibition, Sep. 30-Oct. 3, New Orleans, Louisiana, SPE 71358, 2001.

K.L. Smith, A.D. Gault, D.E. Witt, and C.E. Widdle, Subsea Mudlift Drilling Joint Industry Project: Delivering Dual Gradient Drilling Technology to Industry, Society of Petroleum Engineers, Presented at SPE Annual Technical Conference and Exhibition, Sep. 30-Oct. 3, New Orleans, Louisiana, SPE 71357, 2001.

Unknown, Controlled Mud Level, published to www.IADC.org on May 2015, retrieved from URL http://www.iadc.org/wp-content/uploads/2014/05/controlled-mud-level.pdf on Sep. 4, 2018, May 2014.

Written Opinion of the International Search Authority (USPTO) for PCT International Application No. PCT/US2018/036968, filed on Jun. 11, 2018, dated Aug. 21, 2018.

USPTO non-final office action for U.S. Appl. No. 16/249,135 dated Jul. 25, 2019.

Reissued non-final office action issued in U.S. Appl. No. 16/249,089 dated Aug. 1, 2019.

Reissued non-final office action issued in U.S. Appl. No. 16/249,135 dated Aug. 1, 2019.

USPTO non-final office action dated Jul. 22, 2019, issued in co-pending U.S. Appl. No. 16/249,089.

* cited by examiner

IF MASS FLOW IN = MASS FLOW OUT, THEN PRESSURE = CONSTANT
IF MASS FLOW IN < MASS FLOW OUT, THEN PRESSURE = DECREASING
IF MASS FLOW IN > MASS FLOW OUT, THEN PRESSURE = INCREASING

DUAL GRADIENT DRILLING SYSTEM AND METHOD

CROSS-REFERENCE TO RELATED APPLICATIONS

This application is a continuation of PCT International Application PCT/US2018/036968, filed on Jun. 11, 2018, which claims the benefit of, or priority to, U.S. Provisional Patent Application Ser. No. 62/517,992, filed on Jun. 12, 2017, and U.S. Provisional Patent Application Ser. No. 62/560,153, filed on Sep. 18, 2017, all of which are hereby incorporated by reference in their entirety.

BACKGROUND OF THE INVENTION

As offshore drilling operations move into deeper waters, the hydrostatic pressure exerted on the wellbore by the column of mud in the marine riser may place excessive stress on relatively uncompacted formations, potentially causing the wellbore to fracture and lose circulation. Dual Gradient Drilling ("DGD") refers to systems and methods of drilling in which the amount of pressure exerted on the wellbore by the hydrostatic pressure of the column of mud in the marine riser is reduced by a subsea pump system that assists in lifting the drilling returns from the well. In DGD operations, a heavier mud weight may be used to drill a wellbore resulting in a wellbore pressure profile that more closely mimics natural formation pressure trends. Advantageously, the use of heavier mud weights allows drilling operations to be conducted with substantially fewer casing strings, which are otherwise typically required to prevent wellbore collapse. However, the use of heavier mud weights makes it more difficult for drilling returns to reach the surface.

As such, a common objective of DGD is to reduce the hydrostatic pressure exerted on the wellbore by the column of mud in the marine riser to an amount equal to the seawater hydrostatic pressure on the seafloor. For example, in a drilling system using a 10,000 foot riser with 18.0 pounds per gallon ("ppg") mud weight, the total hydrostatic pressure exerted on the wellbore by the column of mud in the marine riser is approximately equal to 0.52 (industry standard approximation value)*18.0 ppg*10,000 feet, which is 9,360 pounds per square inch ("psi"). However, the seawater hydrostatic pressure at 10,000 feet is approximately equal to 0.52*8.6 ppg*10,000 feet, which is 4,472 psi. As such, in DGD operations, a subsea pump system ideally provides lift that reduces the hydrostatic pressure exerted on the wellbore by the column of mud in the marine riser from 9,360 psi to 4,472 psi, thereby facilitating the flow of drilling returns to the surface.

BRIEF SUMMARY OF THE INVENTION

According to one aspect of one or more embodiments of the present invention, a dual gradient drilling system includes a subsea blowout preventer disposed above a wellhead, the subsea blowout preventer having a central lumen configured to provide access to a wellbore, a lower section of a marine riser fluidly connected to the subsea blowout preventer, a closed-hydraulic positive displacement subsea pump system fluidly connected to the lower section of the marine riser and disposed at a predetermined depth, an annular sealing system disposed above the closed-hydraulic positive displacement subsea pump system, and an independent mud return line fluidly connecting one or more pump heads of the closed-hydraulic positive displacement subsea pump system to a choke manifold disposed on a floating platform of a rig.

According to one aspect of one or more embodiments of the present invention, a riser-less dual gradient drilling system includes a subsea blowout preventer disposed above a wellhead, the subsea blowout preventer comprising a central lumen configured to provide access to a wellbore, a closed-hydraulic positive displacement subsea pump system fluidly connected to the subsea blowout preventer, an annular sealing system fluidly connected above the closed-hydraulic positive displacement subsea pump system, and an independent mud return line fluidly connecting one or more pump heads of the closed-hydraulic positive displacement subsea pump system to a choke manifold disposed on a floating platform of a rig.

According to one aspect of one or more embodiments of the present invention, a distributed riser-less dual gradient drilling system includes a subsea blowout preventer disposed above a wellhead, the subsea blowout preventer comprising a central lumen configured to provide access to a wellbore, an annular sealing system fluidly connected to the subsea blowout preventer, a closed-hydraulic positive displacement subsea pump system fluidly connected to a fluid diversion port of the annular sealing system, and an independent mud return line fluidly connecting one or more pump heads of the closed-hydraulic positive displacement subsea pump system to a choke manifold disposed on a floating platform of a rig.

According to one aspect of one or more embodiments of the present invention, a method of dual gradient drilling includes sealing an annulus surrounding a drill string, pumping drilling fluids down the drill string, using a closed-hydraulic positive displacement subsea pump system to pump returning fluids toward a rig, and controlling inlet pressure of one or more subsea pumps by managing an amount of mass stored in a marine riser and a wellbore disposed below the closed-hydraulic positive displacement subsea pump system without venting hydraulic drive fluid. The amount of mass stored is managed by adjusting a pump speed of the closed-hydraulic positive displacement subsea pump system until a target pressure set point is achieved and then setting the pump speed to match an injection rate into the wellbore such that mass out is approximately equal to mass being injected into the wellbore.

Other aspects of the present invention will be apparent from the following description and claims.

DETAILED DESCRIPTION OF THE INVENTION

Figure 1:
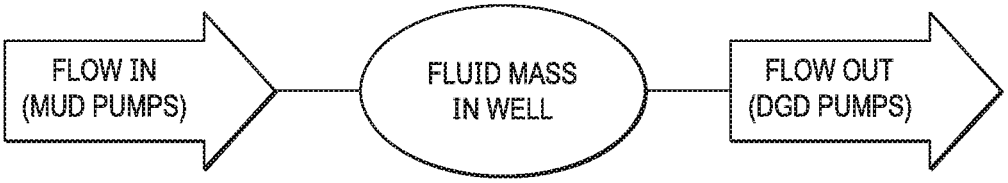
FIG. 1 shows mass flow and its impact on pressure in accordance with one or more embodiments of the present invention.

One or more embodiments of the present invention are described in detail with reference to the accompanying figures. For consistency, like elements in the various figures are denoted by like reference numerals. In the following detailed description of the present invention, specific details are set forth in order to provide a thorough understanding of the present invention. In other instances, well-known features to one of ordinary skill in the art are omitted to avoid obscuring the description of the present invention.

Conventional approaches to DGD operations vary in the configurations of equipment, subsea pump technologies, and operating and control philosophies. For example, U.S. Pat. App. Pub. No. 2013/0206423, published Aug. 15, 2013, entitled "Systems and Methods for Managing Pressure in a Wellbore" (the "'423 Publication"), U.S. Pat. App. Pub. No. 2015/0275602, published Oct. 1, 2015, entitled "Apparatus and Method for Controlling Pressure in a Borehole" (the "'602 Publication"), and U.S. Pat. App. Pub. No. 2016/0168934, published Jun. 16, 2016, entitled "Systems and Methods for Managing Pressure in a Wellbore" (the "'934 Publication") disclose DGD systems where a type of subsea pump system is installed directly on top of a subsea blowout preventer ("SSBOP") at or near the seafloor. This installation depth is advantageous for the disclosed subsea pump system because the system vents hydraulic drive fluid to the sea in what is referred to as an "open hydraulic system." As a result, during normal operations, the subsea pump inlet pressure is at least equal to the seawater hydrostatic pressure at the installation depth. To achieve the common objective of DGD, the disclosed subsea pump system, due to its design, must be placed on the seafloor as opposed to a shallower depth on the riser. As such, the disclosed subsea pump system would not be able to reduce the hydrostatic pressure of the marine riser down to the seawater hydrostatic pressure at the mudline if it was installed at a shallow or mid-riser depth because shallower installation depths require a subsea pump inlet pressure that is lower than, not equal to, the hydrostatic pressure of seawater at the intended installation depth. Moreover, the requirement to place the disclosed subsea pump system on the seafloor to achieve the common DGD objective increases costs substantially. For example, such a system requires additional pumps on the surface that are dedicated to supplying hydraulic drive fluid to the subsea pump heads on the seafloor, lengthy umbilical lines for power and communication, and lengthy hydraulic drive fluid lines which have frictional pressure losses impacting the efficiency of the system.

The '602 Publication discloses a modification to subsea pump systems, like those disclosed in the '423 Publication, in which a centrifugal pump is placed on the hydraulic drive fluid vent line to reduce the inlet pressure of the pump to a value below the seawater hydrostatic pressure at the target riser installation depth, thereby allowing the disclosed subsea pump system to achieve DGD while being installed well above the seafloor. The disclosed system adds cost and complexity due to the addition of the centrifugal pump. The complexity of the disclosed solution is representative of the fact that the industry has only known how to control wellbore pressure with a positive displacement pump that has an open hydraulic system.

European Patent Application Publication WO/0039431, published Jul. 6, 2000, entitled "Method and Device for Adjusting at a Set Value the Bore Fluid Level in the Riser" (the "WO '431 Publication"), discloses a DGD system where a subsea pump system is installed at a mid-riser depth and takes suction from drilling returns in the marine riser and discharges that fluid back to the drilling rig via an independent mud return line. The energy provided by the subsea pump system to execute this operation results in a u-tubing effect which causes the level of drilling mud in the marine riser to drop to a lower level. As such, the amount of marine riser pressure exerted on the wellbore in this DGD system is inconveniently controlled by adjusting the mud level in the riser. A further problem with this DGD method is that it is performed with an open riser above the subsea pump system, requiring another system that manages the presence of dangerous gas in the riser. Moreover, to date, the operations of such systems have only been performed with centrifugal pumps that are substantially less energy efficient than a positive displacement pump. When using a centrifugal pump, the wellbore pressure control method differs from the pressure control method of the claimed invention. The centrifugal pump requires sustained changes in speed to adjust the wellbore pressure. For example, if the wellbore pressure is to be reduced by 100 psi, the disclosed subsea pump system must increase its speed to provide 100 psi of lift and sustain that speed so long as that 100 psi of lift is required.

U.S. Pat. No. 9,068,420, issued Jun. 30, 2015, entitled "Device and Method for Controlling Return Flow from a Bore Hole" (the "'420 patent") discloses a system commonly referred to as a riser isolation device that is intended to address the marine riser gas handling limitations of systems such as that disclosed in the WO '431 Publication. This riser isolation device may be operated as a choke around the drill string or form a full wellbore seal with the intention of protecting against rapid riser gas expansion. However, regardless of how the riser isolation device is used, the disclosed DGD system relies on some form of mud level adjustment within the marine riser in order to achieve a target pressure. For example, when functioning as a riser choke on the drill string, there is still direct pressure communication with mud above the choke so that the riser level can be adjusted. Conversely, when forming a full wellbore seal on the drill string, the disclosed system requires the adjustment of the mud level in the booster line to control the riser pressured exerted on the wellbore.

U.S. Pat. No. 9,322,230, issued Apr. 26, 2016, entitled "Direct Drive Fluid Pump for Subsea Mudlift Pump Drilling Systems" (the "'230 patent") discloses the use of a positive displacement pump with a closed hydraulic system for DGD operations. The disclosed system is limited to either installation on an open riser where the level of drilling mud is permitted to change or installation with a rotating control device above the wellhead with no riser at all. In addition, the metal piston faces of the subsea pump system and dynamic seals disposed thereon are in direct communication with drilling mud, which increases wear/corrosion and reduces the usable life of the subsea pump system. In addition, the '230 patent does not describe a method of controlling wellbore pressure with a positive displacement pump system that does not vent hydraulic drive fluid to the sea. As such, the '230 patent fails to disclose a complete and viable solution comparable to that of the claimed invention.

As such, there is no viable solution capable of conducting closed loop DGD operations, where hydraulic drive fluids are not vented, and the inlet pressure of the subsea pumps, as well as the wellbore pressure, are not controlled by the mud level in the marine riser. Thus, there is a long felt, but unsolved need in the industry for a system and method of DGD operations that is capable of being disposed at shallower installation depths and performing DGD operations in an energy efficient manner without requiring adjustment of the mud level in the marine riser.

Accordingly, in one or more embodiments of the present invention, a system and method of DGD is disclosed that includes a closed-hydraulic positive displacement subsea pump system that may have a subsea installation depth on the riser from shallow to mid-riser or may be disposed on or near the seafloor, with or without a riser. The closed-hydraulic positive displacement subsea pump system may have a closed hydraulic system that does not vent hydraulic drive fluid into the sea or expose dynamic seals to drilling fluids. The inlet pressure of the subsea pumps of the closed-hydraulic positive displacement subsea may be at or near zero psi, thereby allowing the DGD system to reduce riser and/or wellbore pressure down to seawater pressure at the mudline with a much shallower installation depth than an open hydraulic subsea pump system would otherwise be able to achieve. The inlet pressure of the subsea pumps and wellbore pressure may be controlled with one or more methods that do not require adjustment of the mud level in the marine riser, if any, or the venting of hydraulic drive fluid into the sea. The pressure differential across the sealing element of the annular sealing system may be controlled to extend the operational life of the sealing element. The DGD system may also provide riser gas handling capability and facilitate rapid conversion to other types of drilling operations.

In one or more embodiments of the present invention, a system and method of DGD is disclosed that includes an annular sealing system permitting closed loop drilling that ensures marine riser flow is diverted to the surface via an independent mud return line. In certain embodiments, some or all of the returning riser fluids are directed from the subsea pump system to a choke manifold on a floating platform of the drilling rig via an independent mud return line. This configuration also provides protection against hydrocarbon gas breakout. The system may also include an optional bypass riser injection system that may fluidly connect an independent mud return line to the lower section of the marine riser or the wellbore itself above the SSBOP in riser-less embodiments, bypassing the annular sealing system and the closed-hydraulic positive displacement subsea pump system. In such configurations, fluids may be injected directly into the lower section of the marine riser, or the wellbore, from the surface. Including a choke on an independent mud return line permits rapid conversion to Applied Surface Back Pressure ("ASBP")-Managed Pressure Drilling ("MPD") or facilitates Pressurized Mud Cap Drilling ("PMCD") or Floating Mud Cap Drilling ("FMCD") operations via the bypass riser injection line. In addition, the choke manifold protects against rapid gas expansion in the event that gas enters the independent mud return line. A pressure relief valve may also be used to discharge pressurized fluid from beneath the annular sealing system to the upper riser section. Additionally, in one or more embodiments of the present invention, a system and method of DGD may include an anti-u-tubing flow stop valve on the drill string for contingencies while primarily relying on continuous circulation to avoid the impacts of u-tubing during connections. Such an anti-u-tubing flow stop valve may also be placed on the riser booster line for the same reasons. An example of an anti-u-tubing flow stop valve that may be used in such embodiments is disclosed in U.S. Pat. No. 8,066,079, issued on Nov. 29, 2011, entitled "Drill String Flow Control Valves and Methods" (the "'079 patent"), the contents of which are hereby incorporated by reference in their entirety. In certain embodiments, independent mud return line u-tubing may be prevented by check valve assembles integrated with, or external to, the subsea pump system that prevent fluid in the independent mud return line from flowing back downward.

FIG. 1 shows mass flow and its impact on pressure in accordance with one or more embodiments of the present invention. In one or more embodiment of the present invention, a closed-hydraulic positive displacement subsea pump system may be used with an annular sealing system as part of a DGD system. As a preliminary consideration, if the mass flow into a well is equal to the mass flow out of the well, the pressure in the well will remain constant. However, if the mass flow into the well is less than the mass flow out of the well, the pressure in the well will decrease. If the mass flow into the well is greater than the mass flow out of the well, the pressure in the well will increase.

A well volume may be defined as the summation of the annular volume of the well and marine riser below the subsea pump system, the fluid volume contained within the entire drill string, and the volume of all pipe work or other volumes fluidly connected to the well volume. The annular volume of the marine riser above the subsea pump system is not considered part of the well volume and neither is the volume of the independent mud return line if present. The well volume may include a drilling fluid which may be composed of a mixture of solids, liquids, and gases. The continuous liquid phase may consist of an oil, water, or synthetic base. Drilling fluid solids may include weighting agents and viscosity agents which may be used to affect the density and cuttings transport efficiency of the drilling fluid. Drilling fluid density is usually measured at the surface at nearly standard temperature and pressure. Other agents may be added to the drilling fluid to improve performance of the fluid. With an assumed density, a well mass may be calculated for any known volume by the following equation:

$$\text{Well Mass} = (\text{Drilling Fluid Density})\left[\frac{\text{kg}}{\text{l}}\right] \times (\text{Well Volume})\ [\text{l}]$$

Drilling fluid density is given in units of kilograms per liter and well volume is given in units of liters. The purpose of this equation is to estimate the mass of the well. However, from this equation, it is apparent that if the drilling fluid is displaced or circulated out for a drilling fluid of higher density, the well mass increases proportionally for a constant volume. Also, if the drilling fluid remains constant as the well is drilled to greater depths, the well mass increases in proportion to the volume added to the well by drilling new footage.

In the drilling industry, drilling fluid quantities are commonly referred to in terms of volume, due to the ease with which volume may be measured. It is less common in the drilling industry to refer to drilling fluid quantities in terms of their mass. For a well in a static, non-circulating state, the pressure as a function of depth for a uniform well profile is given by the following equation:

$$\text{Pressure}=(\text{Density})\times(\text{True Vertical Depth})\times(\text{Gravitation Constant})$$

The equation is commonly used to calculate the pressure of a hydrostatic column and assumes a constant density throughout the well profile.

Compressibility, the inverse of bulk modulus, is a term for which any fluid describes the relationship between pressure and density. Of the most common fluids found in a well, gases have higher compressibility, liquid hydrocarbons have a lower compressibility, while water has yet a lower compressibility. The isothermal compressibility of drilling fluid is known in the industry and is defined in the following equation:

$$\beta_T = -\frac{1}{V}\left(\frac{\partial V}{\partial P}\right)_T$$

The isothermal compressibility equation describes the change in volume a given fluid quantity exhibits as a function of pressure applied to the system at a constant uniform temperature.

Drilling fluid density is not constant as a function of depth. On the contrary, it is most common that in a drilling fluid of uniform composition, the density increases as a function of depth due to the compressibility of the fluid and the pressure exerted on the drilling fluid by the hydrostatic column above. Put in more practical terms, for the fluidly connected fluid in the annulus of a well, the density is least near the surface, higher near the SSBOP, and highest where the true vertical depth is greatest. Extending this, it may be said that a barrel of fluid sampled at surface pressure has the least mass, more mass when sampled at the SSBOP, and the highest mass when sampled where the true vertical depth is the greatest. As a quantity of drilling fluid is circulated from the bottom of the well to the surface, the drilling fluid expands slightly due to the decrease in pressure. This expansion results in the volumetric flow rate near the surface increasing slightly over points deeper in the annulus. This is necessarily true so that the mass is conserved while density and volumetric flow rate vary, all of which has been verified through simulation modeling of uniform fluids at various pressures.

Further, by adding back pressure to the entire well as with an ASBP-MPD system, the pressure of the entire well volume may be manipulated within the constraints of the equipment. For a well of fixed volume, as the well pressure is increased, the fluid in the well becomes slightly denser due to the compressibility, which is to say that a constant volume at higher pressure stores more fluid mass. As pressure is increased, a mass accumulation occurs in the well system which may be referred to in terms of mass or in terms of volume at the given conditions. The inverse is true as well, where for a well of a fixed volume, as the well pressure is decreased, the fluid in the well becomes slightly less dense due to the compressibility, which is to say that a constant volume at lower pressure stores less fluid mass.

The volumetric flow rate of the positive displacement subsea pump system is manipulated to control the amount of drilling fluid mass contained within the volume upstream of the positive displacement subsea pump (i.e., the well volume as defined above). The correlation between the volumetric flow rate and the mass flow rate is given by the following equation:

$$\text{Mass Flow Rate}\left[\frac{\text{kg}}{\text{min}}\right] = \text{Drilling Fluid Density}\left[\frac{\text{kg}}{\text{l}}\right] \times \text{Volumetric Flow Rate}\left[\frac{\text{l}}{\text{min}}\right]$$

As the pump rate of the positive displacement subsea pump system is increased, a point is reached where the pump speed is sufficient to pump the same amount of drilling fluid mass per unit of time as the mud pumps on the rig inject into the drill string. When the positive displacement subsea pump system has leverage and is pumping the same mass flow rate as the rig mud pumps, the suction pressure remains constant as does the pressure throughout the well.

In order to reduce the suction pressure at the positive displacement subsea pump, the subsea pump speed is increased to remove mass from the well volume at a faster rate than the rig mud pumps inject mass. Once the target suction pressure is reached, the pump speed of the positive displacement subsea pump system is reduced to again balance the mass flow from the rig mud pumps and stabilize the inlet pressure of the subsea pumps.

In order to increase the suction pressure at the positive displacement subsea pump, the pump speed of the positive displacement subsea pump system is decreased to allow mass in the well volume to accumulate. Once the target suction pressure is reached, the pump speed of the positive displacement subsea pump system is increased to again balance the mass flow from the rig mud pumps and stabilize the suction pressure.

The system may be sensitive to changes in compressibility of the fluid and well system upstream of the positive displacement subsea pump system. In addition to the drilling fluid base (continuous phase), additives to the drilling fluid, exposed geological formations, increasing well volumes, and background gas may add to the compressibility of the wellbore system. This results in a system which is quicker to make adjustments at shallower depths, and slightly slower with greater well volumes and greater formation compressibility. When drilling with oil-based drilling fluids, it is common that the drilling of a gas bearing formation results in gas entering solution in the drilling fluid. Using conventional surface based volumetric tracking, it is typically not possible to detect gas in solution until the gas has significantly expanded near the surface. The gas component in solution affects both the mass of the fluid in the well and the compressibility of the same. As the compressibility increases, a greater amount of drilling fluid must be removed from the well in order to maintain suction pressure. Therefore, it can be seen that changes either to the pump speed or the suction pressure may indicate gas in solution.

Figure 2:
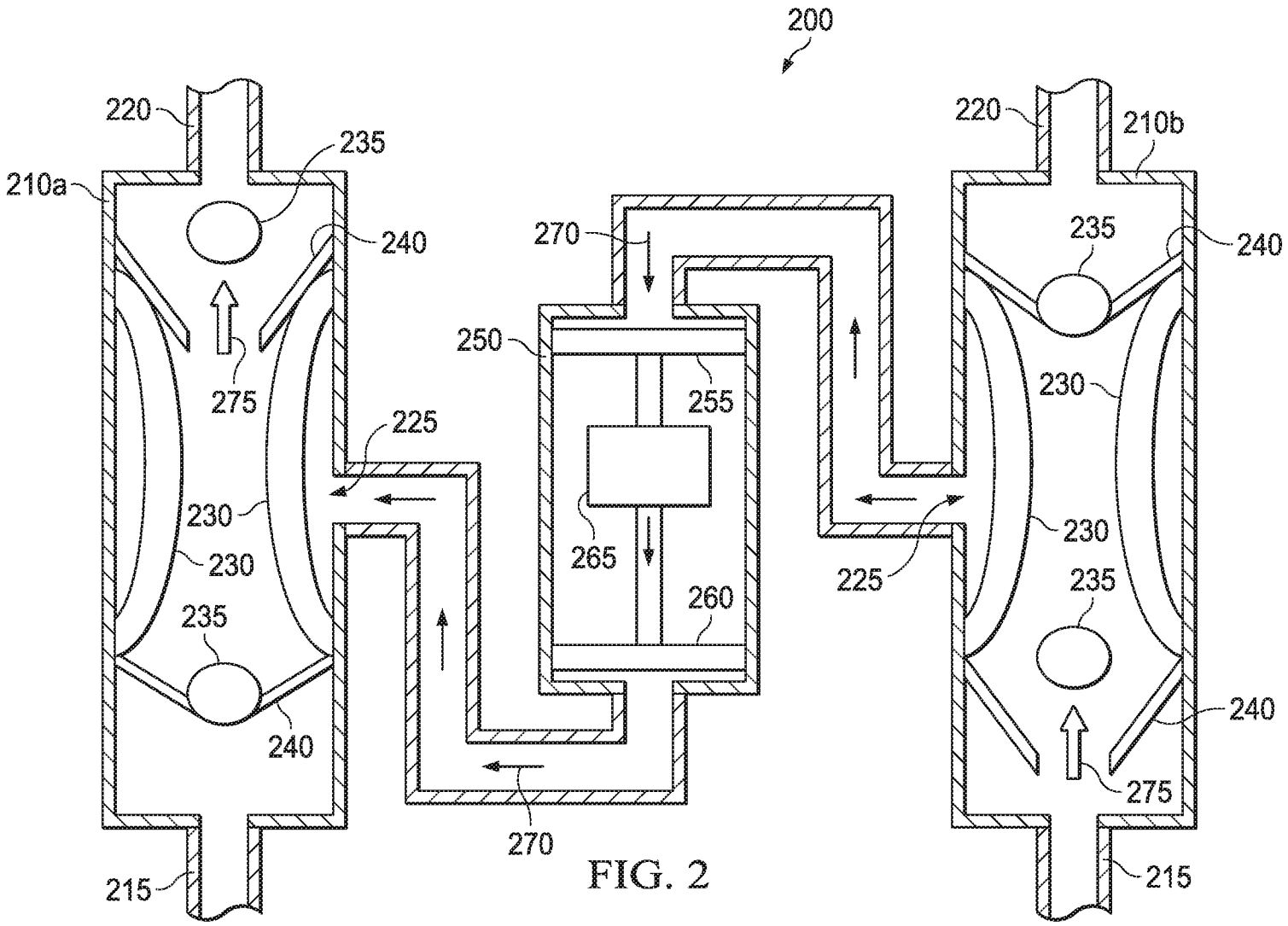
FIG. 2 shows a first pump cycle of a closed hydraulic positive displacement subsea pump system in accordance with one or more embodiments of the present invention.

FIG. 2 shows a first pump cycle of a closed-hydraulic positive displacement subsea pump system 200 in accordance with one or more embodiments of the present invention. In certain embodiments, pump system 200 may be a hose diaphragm piston pump system. Closed-hydraulic positive displacement subsea pump system 200 may include a first pump head 210*a*, an independent linear drive motor 250, and a second pump head 210*b*. Each pump head 210 may include an inlet port 215, a bottom check valve assembly 235, 240, a fluid 275 cavity disposed between pressure balanced liners 230, a top check valve assembly 235, 240, and an outlet port 220. Linear drive motor 250 may include a reciprocating piston 265 having a first piston face 255 and a second piston face 260 that may be electronically driven to compress hydraulic drive fluid 270 disposed on the first pump head 210*a* side of second piston face 260, while uncompressing hydraulic drive fluid 270 disposed on the second pump head 210*b* side of first piston face 255 during the first pump cycle and reversing operation during a second pump cycle. Because reciprocating piston 265 has piston faces 255, 260 disposed on distal ends, piston faces 255, 260 are always at 180-degree phase shift allowing for smooth reciprocation without loss of synchronization.

In operation, during the first pump cycle depicted in the figure, reciprocating piston 265 drives second piston face 260 down, compressing hydraulic drive fluid 270 in a first cavity 225 formed by pressure balanced liner 230 of first pump head 210*a*. This increased hydraulic pressure squeezes pressure balanced liner 230, thereby forcing lower ball 235 on seat 240 closing inlet port 215 and forcing upper ball 235 off seat 240, allowing drilling fluids 275 within a cavity bound by pressure balanced liners 230 to flow out of outlet port 220 of first pump head 210*a*. As first piston face 255 moves down, hydraulic drive fluid 270 in a second cavity 225 formed by pressure balanced liner 230 of second pump head 210*b* is uncompressed. This reduced hydraulic pressure backs off pressure balanced liner 230, thereby forcing upper ball 235 on seat 240 closing outlet port 220 and forcing lower ball 235 off seat 240, drawing drilling fluids 275 into a cavity bounded by pressure balanced liners 230 of the second pump head 210*b*. One of ordinary skill in the art will recognize that, during the second pump cycle, the operation described above is reversed with respect to first pump head 210*a*, linear drive motor 250, and second pump head 210*b*. One of ordinary skill in the art will also recognize that the check valve assemblies 235, 240 may be disposed upstream or downstream of pump heads 210*a*, 210*b* in distributed embodiments that do not include integrated check valve assemblies.

In certain embodiments, in order to enhance the smoothness of the pressure control methods disclosed herein, in addition to the first pair of pump heads 210*a*, 210*b*, and their associated linear drive motor 250, a secondary pair of pump heads 210*a*, 210*b*, as well as another linear drive motor 250 may be used. In such embodiments, the linear drive motors 250 may be synchronized for the smoothest possible flow. One of ordinary skill in the art will recognize that the number of pairs of pump heads 210*a*, 210*b* and linear drive motors 250 may vary based on an application or design in accordance with one or more embodiments of the present invention.

In one or more embodiments of the present invention, closed-hydraulic positive displacement subsea pump system 200 may operate at pressures in a range between 500 psi and 5,000 psi or more. This is in contrast to conventional centrifugal subsea pump systems that typically operate between 200 psi and 500 psi and are not capable of functioning in DGD operations because their lack of energy efficiency would require impractical amounts of power from an offshore drilling rig. Advantageously, closed-hydraulic positive displacement subsea pump system 200 includes hydraulic drive fluid 270 that is wholly contained by pump system 200 and does not vent hydraulic drive fluid 270 into the sea. As such, a DGD system may be deployed capable of achieving full dual gradient effect while being installed mid-riser instead of on the seafloor, thereby reducing costs and frictional losses. Further, such a DGD system does not require the added space, cost, or complexity of dedicated pumps disposed on the surface that supply hydraulic drive fluid to the subsea pump system. Moreover, the pressured balanced liners 230 of each respective pump head 210*a*, 210*b*, fully isolate hydraulic drive fluid 270 from drilling fluid 275. As such, closed-hydraulic positive displacement subsea pump system 200 does not include dynamic seals that are exposed to drilling fluids 275.

Figure 3:
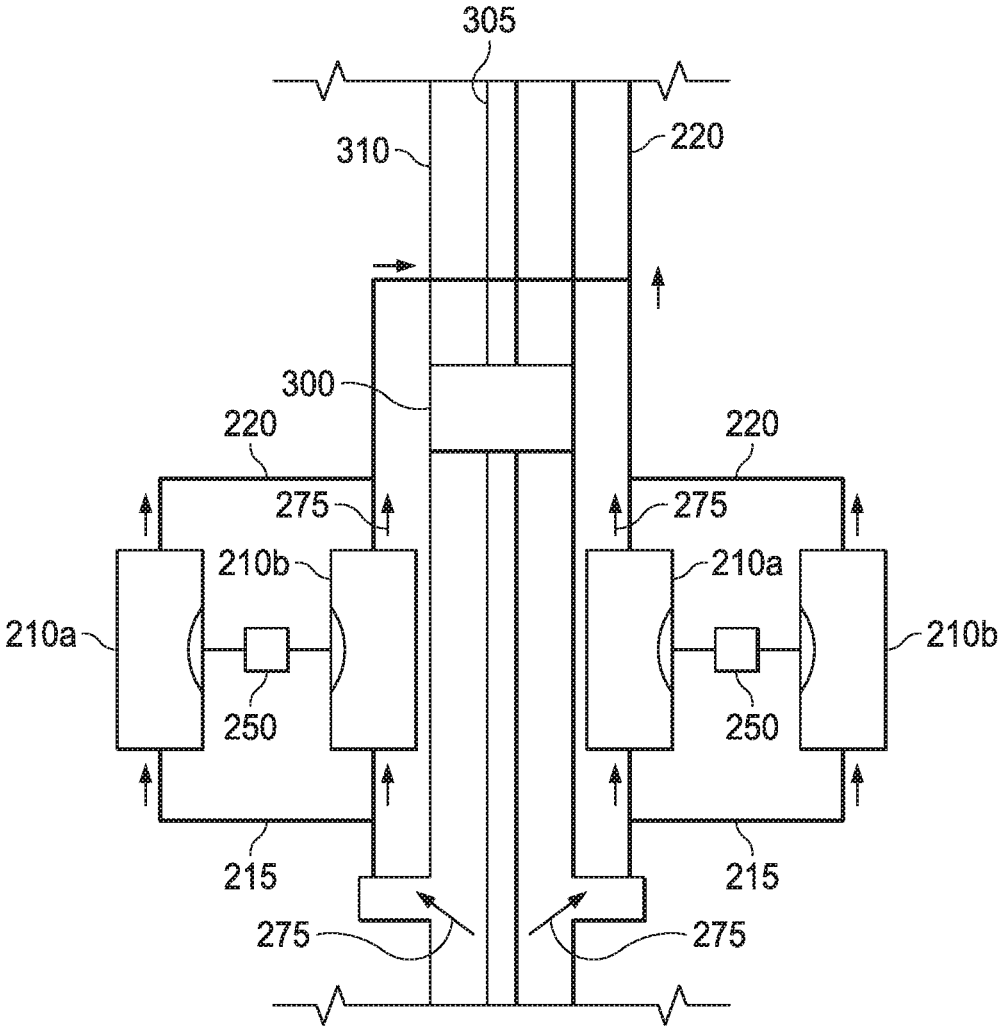
FIG. 3 shows a schematic of a dual gradient drilling system with independent mud return line for shallow or mid-riser installation depths in accordance with one or more embodiments of the present invention.

In one or more embodiments of the present invention, a DGD system may be operated on the principles of a Controlled Wellbore Storage Method ("CWSM"), which differs from conventional methods that require adjusting the mud level in the riser system or venting hydraulic drive fluid. During CWSM operations, mass flow into and out of the well may be controlled by the speed of the mud pumps on the rig and the subsea pumps of the DGD system. In order to obtain a target inlet pressure at the subsea pumps, the subsea pump speed of the subsea pumps is increased or decreased temporarily to achieve a target amount of fluid mass in the fluidly connected system upstream of the subsea pump system 200. In doing so, the riser and wellbore fluid is either energized or de-energized which contributes to achieving a target inlet pressure at the subsea pumps and subsequent wellbore pressure profile. It should be noted that, unlike a centrifugal pump or other pump technology previously discussed, once the target mass/pressure profile in the well and riser is achieved, the subsea pump speed may be returned back to a steady state speed in which the mass flow into the drill string equals the mass flow out of the riser. In doing so, wellbore pressure is held constant at the new target pressure. CWSM may be used in conjunction with any positive displacement subsea pump system that does not vent hydraulic drive fluid (closed-hydraulic), including all embodiments disclosed herein, regardless of where installed (e.g., on the wellhead, above the seafloor, within close proximity to the seafloor, on the seafloor itself, or somewhere on the marine riser). It should also be noted the changes in mass flow rate may also be induced by changing the speed of the pumps on the rig which can ultimately be done to achieve the same affect described above. A high precision pump (high pressure, low flow rate) may also be installed on the rig for purposes of controlling mass flow into the well to further improve the precision at which wellbore pressure adjustments can be made FIG. 3 shows a schematic of a dual gradient drilling system with independent mud return line for shallow or mid-riser installation depths in accordance with one or more embodiments of the present invention. In certain embodiments, a mid-riser dual gradient drilling system with independent mud return line may include a closed-hydraulic positive displacement subsea pump system 200 disposed below an annular sealing system 300 as part of a marine riser 310 system. Annular sealing system 300 may be a rotating control device, an active control device, or other annular packer or sealing device that persistently or controllably seals the annulus between drill string 305 and marine riser 310 or the annulus surrounding drill string 305.

Active control devices allow for the hydraulic engagement or disengagement of the annular seal (not independently illustrated) and do not require bearing assemblies. When engaged, the annulus may be sealed, thereby isolating an upper section of marine riser 310 above the sealing element (not independently illustrated) of annular sealing system 300 from a lower section of marine riser 310 below pump system 200. When disengaged, the annular sealing element (not independently illustrated) of annular sealing system 300 may be relaxed, such that fluids may flow between the upper section of marine riser 310 above annular sealing system 300 and the lower section of marine riser 310 below pump system 200. Annular sealing system 300 may include one or more sealing elements. Annular sealing system 300 may be operated remotely and/or wirelessly.

Figure 4:
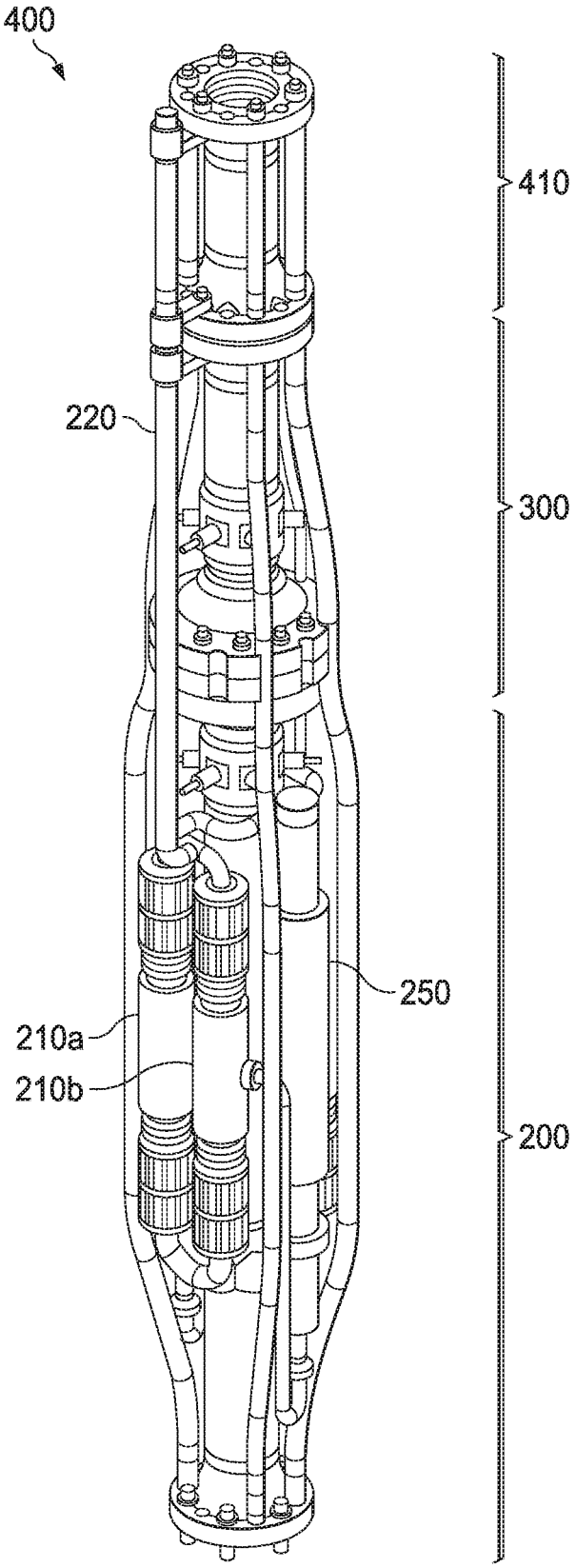
FIG. 4 shows a perspective view of a dual gradient drilling system with independent mud return line in accordance with one or more embodiments of the present invention.

FIG. 4 shows a perspective view of a DGD system with independent mud return line 400 in accordance with one or more embodiments of the present invention. DGD system 400 may include a closed-hydraulic positive displacement subsea pump system 200, an annular sealing system 300, an independent mud return line 220, and may optionally include an adapter 410, one or more of which may serve as an integrated riser joint capable of being deployed as part of a marine riser (not shown) system.

Closed-hydraulic positive displacement subsea pump system 200 may include a pair of pump heads 210*a*, 210*b* that are driven by an independent linear drive motor 250. One of ordinary skill in the art will recognize that one or more pairs of pump heads 210*a*, 210*b* and linear drive motor 250 may be used in accordance with one or more embodiments of the present invention. An independent mud return line 220 may fluidly connect the outlet port of each pump head to a choke manifold (not shown) disposed on a floating platform of a rig (not shown) on the surface. Independent mud return line 220 may be removably secured to a spare or auxiliary port on a riser flange or flanges above it. Annular sealing system 300 may be an active control device, a rotating control device (not shown), or other annular packer or sealing device (not shown) capable of sealing the annulus surrounding the drill string (not shown). Annular sealing system 300 may include one or more sealing elements that seal the annulus surrounding the drill string (not shown) disposed through a central lumen of DGD system 400.

Figure 5:
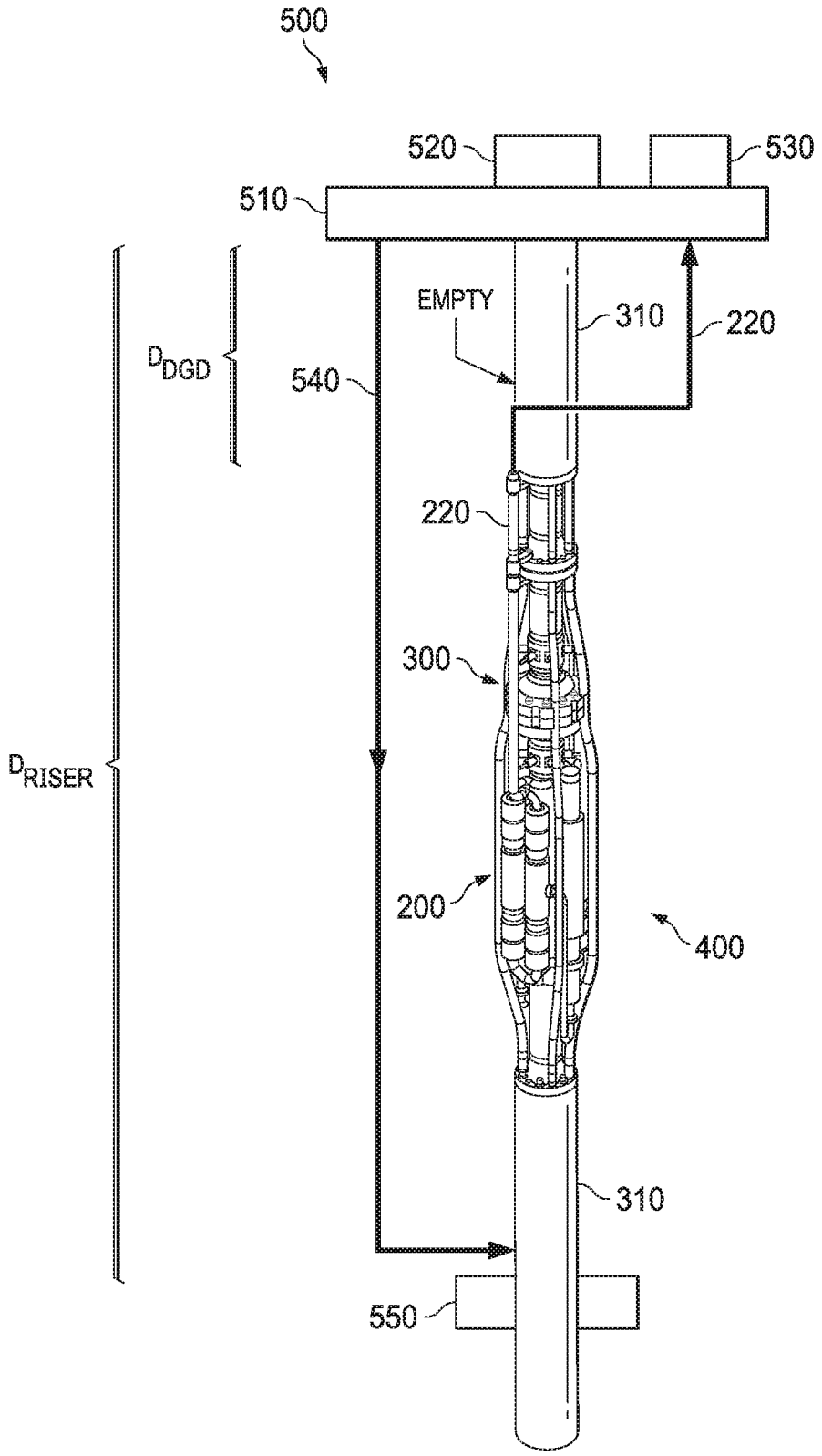
FIG. 5 shows a mid-riser configuration of a dual gradient drilling system with independent mud return line in accordance with one or more embodiments of the present invention.

FIG. 5 shows a mid-riser configuration 500 of DGD system with independent mud return line 400 in accordance with one or more embodiments of the present invention. Mid-riser DGD system 400 configuration 500 may include a SSBOP 550 disposed above a wellhead (not independently illustrated) at depth $D_{RISER}$. In certain embodiments, depth, $D_{RISER}$, may be in a range between 7,500 feet and 10,000 feet or more. SSBOP 500 may include a central lumen configured to provide access to a wellbore (not shown) drilled into the subsea surface of the Earth. A lower section of a marine riser 310, disposed below DGD system 400, may fluidly connect to the central lumen of the SSBOP 550 and the wellbore (not shown). For the purposes of this disclosure, marine riser 310 may refer to one or more tubulars, potentially including one or more riser joints, disposed along the seawater depth to SSBOP 550 disposed at or near the seafloor. The terms upper and lower may refer to marine riser sections that are disposed above or below the DGD system respectively.

DGD system 400 may include a closed-hydraulic positive displacement subsea pump system 200 that fluidly connects to the lower section of marine riser 310, where pump system 200 is disposed at a predetermined depth, $D_{DGD}$. In certain embodiments, the predetermined depth, $D_{DGD}$, may be in a range between 3,500 feet and 5,500 feet or more, typically at or near mid-riser level. An annular sealing system 300 may be disposed above closed-hydraulic positive displacement subsea pump system 200. Annular sealing system 300 may be an active control device, a rotating control device (not shown), or an annular packer or sealing device (not shown) configured to seal an annulus surrounding a drill string (not shown) disposed therethrough. Annular sealing system 300 may include one or more sealing elements. An independent mud return line 220 may fluidly connect one or more pump heads of closed-hydraulic positive displacement subsea pump system 200 to a choke manifold 530 disposed on a floating platform 510 of a drilling rig (not independently illustrated). One should note, the installation depth is a direct function of the required operating window to execute drilling a hole section. As such, a different objective from what is suggested above may result in a more shallow installation depth as well.

During closed loop DGD operations, drilling fluids may be injected into marine riser 310 via the drill string (not shown) and/or a riser booster line 540, while closed-hydraulic positive displacement subsea pump system 200 controls the inlet pressure of the pump heads and, as a consequence, the wellbore pressure. In certain embodiments, closed-hydraulic positive displacement subsea pump system 200 may have an inlet pressure of the pump heads as low as needed for a given installation depth, $D_{DGD}$, to reduce annular pressure at SSBOP 550 to its equivalent seawater hydrostatic pressure. While all riser returns are directed into the pump heads of pump system 200, annular sealing system 300 permits wellbore pressure to be controlled without adjusting fluid levels in marine riser 310.

Closed-hydraulic positive displacement subsea pump system 200, annular sealing system 300, independent mud return line 220, booster line 540, and remainder of standard riser auxiliary lines (not shown) may be concentrically packaged on a tubular, or integrated riser joint, 400 that is intended to be installed as part of marine riser system 310 with a central lumen, or bore, wide enough to drift tools downhole for normal and contingency operations. Pump system 200 may discharge riser returns through independent mud return line 220, which is directed to a choke manifold 530 disposed on a platform 510 of the drilling rig (not independently illustrated). In certain embodiments, independent mud return line 220 may be clamped to an exterior of a riser joint or clamped to a spare or auxiliary line port in each riser flange. In other embodiments, riser joints may be modified to permit independent mud return line 220 to be run through a spare or auxiliary line port, though this may be more expensive. By clamping independent mud return line 220 to the exterior of riser 310, the cost of preparing an existing riser for DGD operations may be significantly reduced. Reducing such costs improves the economic viability of sharing a pump system 200 between multiple drilling rigs (not shown) operating in relatively close quarter. While choke manifold 530 may be disposed on platform 510 of the drilling rig (not independently illustrated), one of ordinary skill in the art will recognize that choke manifold 530 may be disposed subsea and function in a similar manner. A continuous circulation system 520 may be used to reduce or eliminate drill string (not shown) u-tubing effects when the pumps are shut down for drill pipe connection (not shown).

For purposes of illustration only, mid-riser configuration 500 of DGD system 400 may be used to conduct DGD operations using, for example, 16 ppg drilling mud. Closed-hydraulic positive displacement subsea pump system 200 may be installed at $D_{DGD}$ of 4,800 feet seawater depth, roughly mid-riser as part of a 10,000 feet riser 310 system. One of ordinary skill in the art will recognize that 5,200 feet of 16 ppg drilling mud generates approximately 4,326 psi of hydrostatic pressure, which is approximately equal to the hydrostatic pressure of seawater on the seafloor at a 10,000 foot depth.

The inlet pressure (not shown) of pump system 200 may be set to zero leaving a negligible pressure differential across the sealing element (not independently illustrated) of annular sealing system 300, because the subsea pump system 200 may supply enough lift to offset the entire hydrostatic pressure of the column of drilling mud above the subsea pump system. In other embodiments, discussed in more detail herein, the inlet pressure (not shown) of pump system 200 may be set, or circumstances may dictate, that there is a non-negligible pressure differential across the sealing element (not shown) of annular sealing system 300. The sealing element (not shown) of annular sealing system 300 may be capable of holding such pressure differential. However, because the pressure differential may be very low or zero across the sealing element (not shown), the strength of the sealing element (not shown) of annular sealing system 300 need not be the pressure limiting factor of a DGD system. The inlet pressure (not shown) of pump system 200 may also be set to a small value above zero in order to prevent cavitation of pump system 200.

DGD operations may be conducted with continuous circulation. Gas in marine riser 310 may be controlled by annular sealing system 300 and diversion of riser fluids through independent mud return line 220 to choke manifold 530 and a mud-gas-separator (not shown) disposed on a floating platform 510 of the drilling rig (not shown). If the pump heads of pump system 200 are shut down, choke manifold 530 may be used for ASBP-MPD while riser returns simply flow through the pump heads as if the pump heads were merely a joint of riser 310 with, for example, a restriction. This scenario may be practical for an Equivalent Circulating Density ("ECD") control application where drilling mud density is often lighter or a contingency case if an unexpected high-pressure formation zone is encountered. However, even in a mud line DGD scenario with pump system 200 running, choke manifold 530 may remain operational and protect against rapid expansion of gas in independent mud return line 220.

Figure 6:
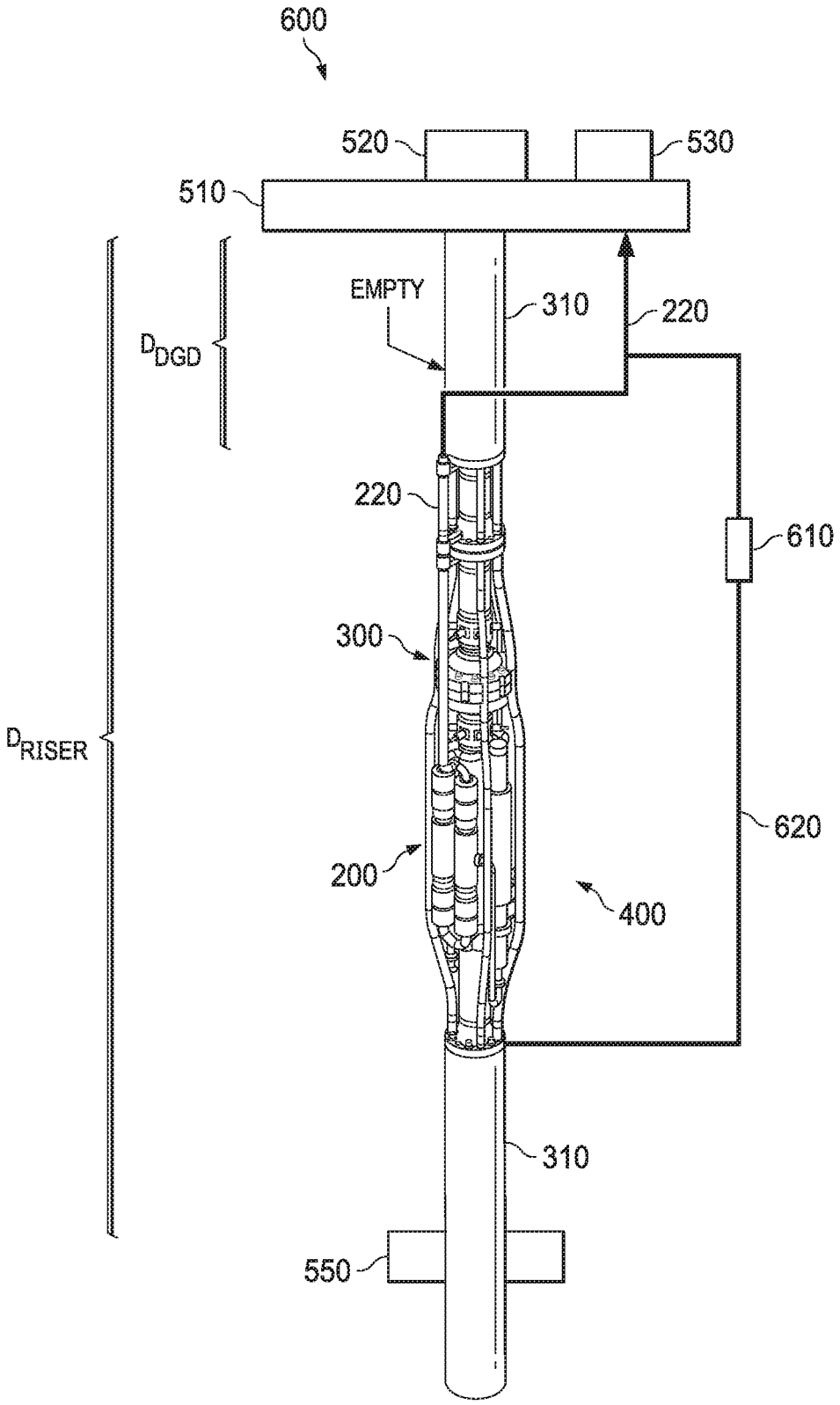
FIG. 6 shows a mid-riser configuration of a dual gradient drilling system with independent mud return line and bypass riser injection system in accordance with one or more embodiments of the present invention.

FIG. 6 shows a mid-riser configuration 600 of a DGD system with independent mud return line 400, similar to configuration 500 of FIG. 5, which includes a bypass riser injection system 610, 620 in accordance with one or more embodiments of the present invention. Configuration 600 allows DGD system 400 to be rapidly converted from DGD operations to PMCD or FMCD operations when there is a total loss of drilling fluids (not shown) downhole. In certain embodiments, such as, for example, for PMCD or FMCD operations, bypass riser injection system 610, 620 may be used to bypass annular sealing system 300 and closed-hydraulic positive displacement subsea pump system 200 for injection of fluids directly into the lower section of marine riser 310 disposed below closed-hydraulic positive displacement subsea pump system in total loss drilling conditions. Specifically, pump system 200 may be stopped and independent mud return line 220 may be fluidly connected by opening isolation valve 610 that fluidly connects to a fluid flow line 620 to bypass closed-hydraulic positive displacement subsea pump system 200 and fluids (not shown) may be injected from the surface directly to the lower section of marine riser 310 for PMCD or FMCD operations. In such embodiments, choke manifold 530 may be placed in direct fluid communication with the wellbore (not shown).

In DGD operations, there exists a point where the hydrostatic pressure of drilling mud lifted by the subsea pump system 200 will fracture the wellbore (not shown) if placed into pressure communication with the riser 310/wellbore annulus below. In certain embodiments, this may be prevented, even in the event of a total loss of rig power, a failure of mud pumps (not shown), a failure of pump system 200, or a well control event with SSBOP 550 closed. One of ordinary skill in the art will recognize that, under such conditions, continuous circulation is not available or useful.

Figure 7:
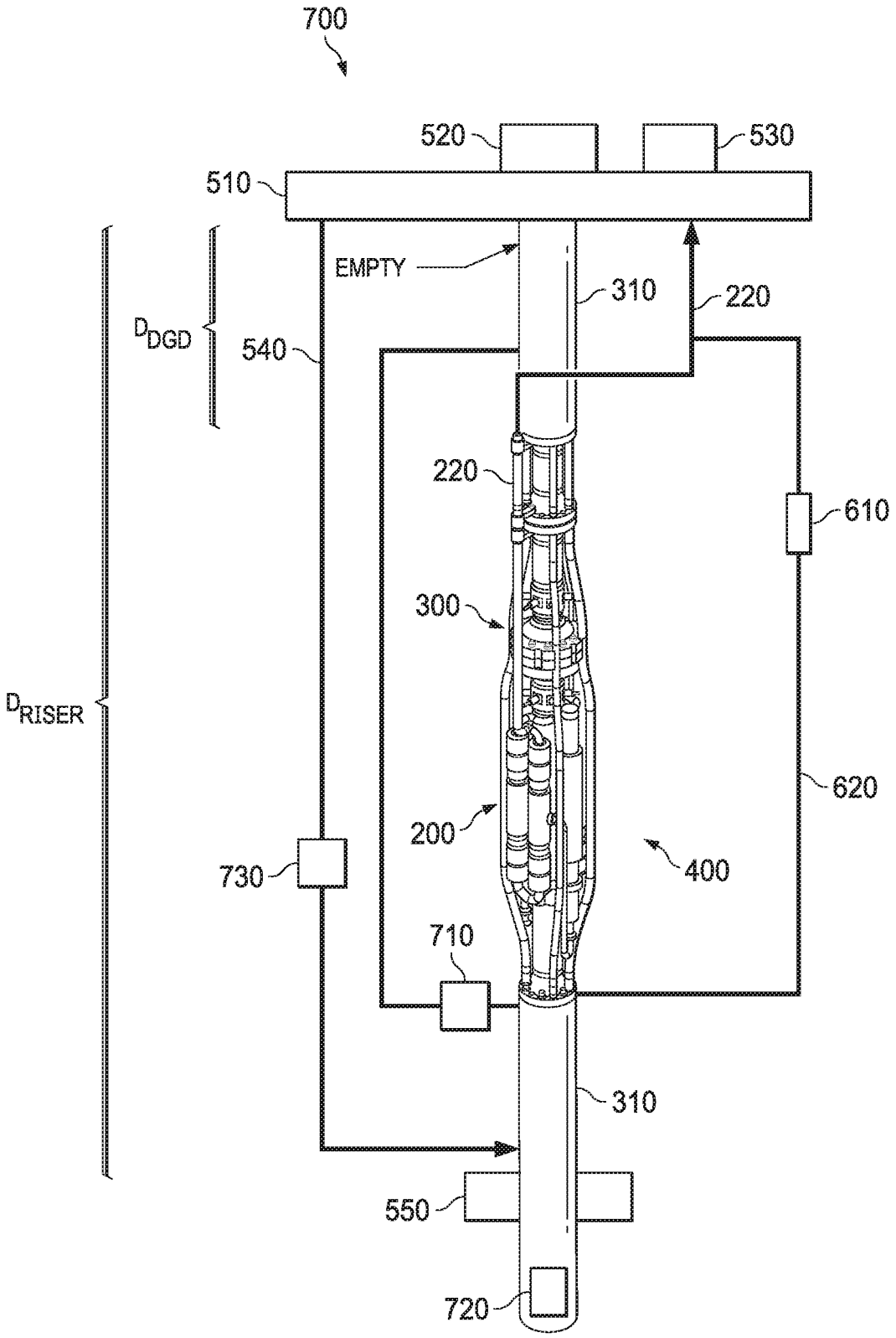
FIG. 7 shows a mid-riser configuration of a dual gradient drilling system with independent mud return line, bypass riser injection system, and exemplary contingency features, including a pressure release valve disposed below the annular sealing system in accordance with one or more embodiments of the present invention.

FIG. 7 shows a mid-riser configuration 700 of a DGD system with independent mud return line 400 and bypass riser injection system 610, 620, similar to configuration 600 of FIG. 6, with exemplary contingency features, including a pressure relief valve 710 disposed below annular sealing system 300 in accordance with one or more embodiments of the present invention. For example, an anti-u-tubing flow stop valve 720 may be disposed on the drill string (not shown) downhole to prevent drilling mud from u-tubing into the annulus (not shown) surrounding the drill string (not shown) and fracturing the wellbore (not shown) in the event the subsea pumps unexpectedly shut down or fail or when SSBOP 550 is closed.

An anti-u-tubing flow stop valve 730 may be disposed on booster line 540 that fluidly connects continuous circulation system 520 disposed on floating platform 510 of a drilling rig (not independently illustrated) to the lower section of marine riser 310 near SSBOP 550. Anti-u-tubing flow stop valve 730 may prevent wellbore fracturing attributed to booster line 540 u-tubing, for example, if subsea pump system 200 unexpectedly shuts down or fails.

A pressure relief valve 710 may fluidly connect the lower section of marine riser 310 disposed below closed-hydraulic positive displacement subsea pump system 200 to an upper section of marine riser 310 disposed above annular sealing system 300, which may prevent an over-pressuring of the wellbore due to u-tubing of drilling mud in the drill string (not shown) and booster line 540 in the event of an unexpected shut down or failure of pump system 200. In such a situation, pressure relief valve 710 would open when the inlet pressure of pump system 200 exceeds an unsafe value.

As a backup to the check valve assemblies (not shown) of pump system 200 and to help prevent independent mud return line 220 u-tubing, an annular packer or sealing device (not shown) may be disposed below closed-hydraulic positive displacement subsea pump system 200. In addition, isolation valves (not shown) may also be disposed on the inlet or outlet ports (not independently illustrated)

Figure 8:
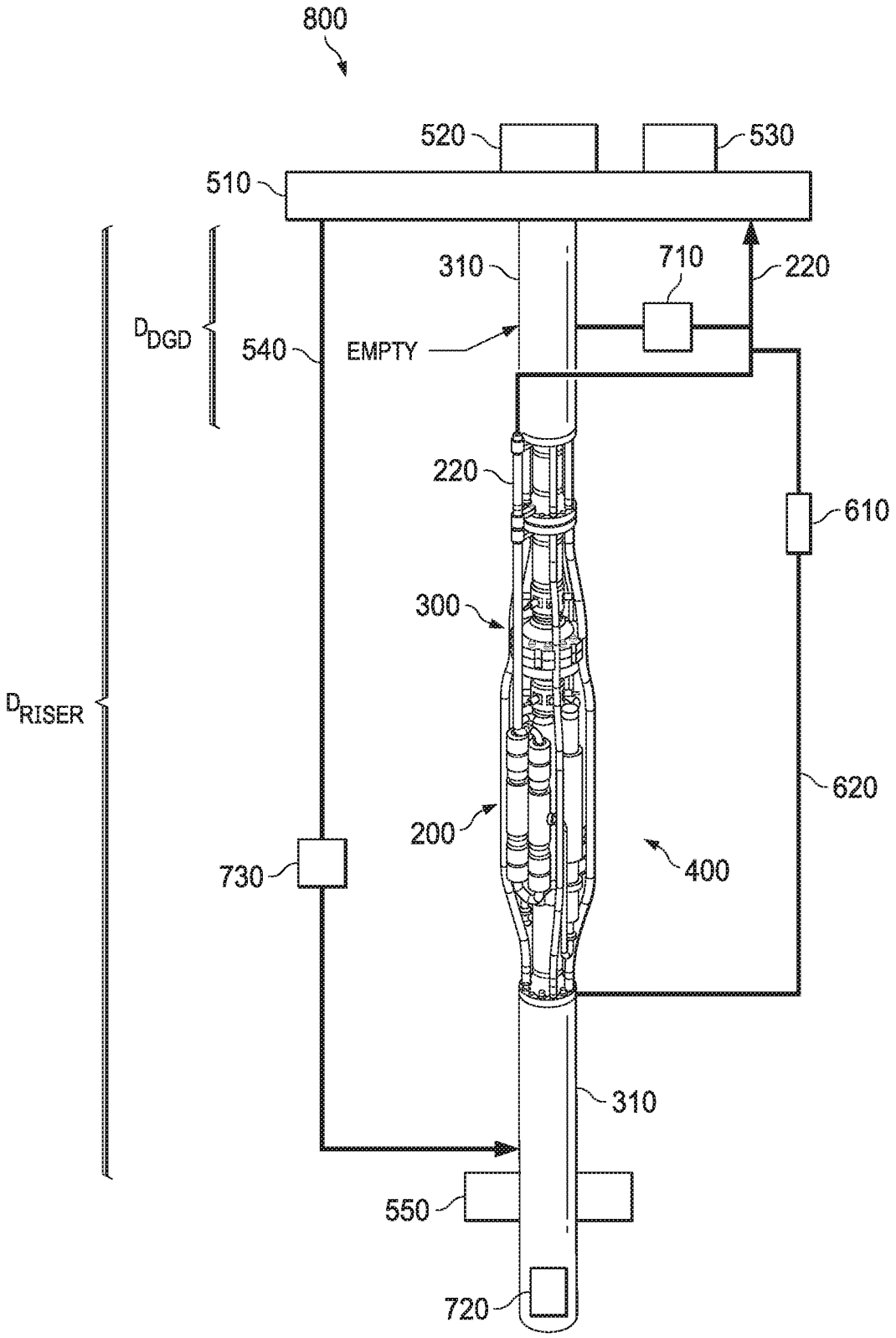
FIG. 8 shows a mid-riser configuration of a dual gradient drilling system with independent mud return line, bypass riser injection system, and exemplary contingency features, including a pressure release valve disposed above the annular sealing system in accordance with one or more embodiments of the present invention.

FIG. 8 shows a mid-riser configuration 800 of a dual gradient drilling system with independent mud return line 400, bypass riser injection system 610, 620, and exemplary contingency features, including a pressure release valve 710 disposed above annular sealing system 300 in accordance with one or more embodiments of the present invention. Pressure relief valve 710 may fluidly connect independent mud return line 220 to an upper section of marine riser 310 disposed above annular sealing system 300. This pressure relief valve 710 may protect against the same contingencies discussed above.

Figure 9A:
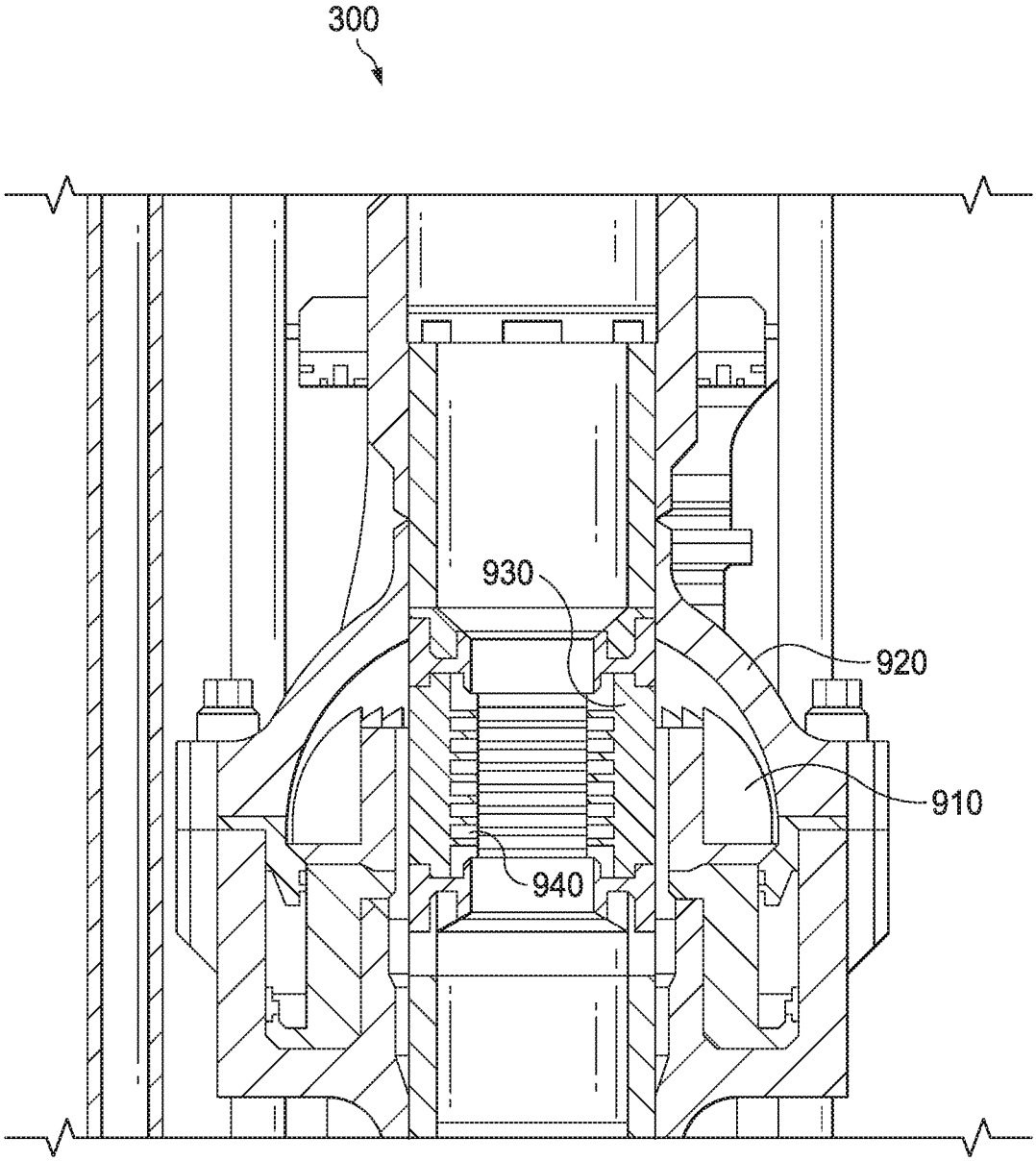
FIG. 9A shows a cross-sectional view of an active control device in accordance with one or more embodiments of the present invention.

FIG. 9A shows a cross-sectional view of an active control device 300 in accordance with one or more embodiments of the present invention. Active control device 300 may be a type of annular sealing system 300 that includes a seal sleeve that does not rotate with the drill string (not shown). A piston-actuated annular packer with fingers 910, when actuated, travels within the hemispherical portion of the housing 920, thereby causing the elastomer or rubber portion to deform and squeeze a seal sleeve 930. Seal sleeve 930 may include a co-molded urethane matrix reinforced with a polytetrafluoroethylene cage 940. Seal sleeve 930 does not rotate and controllably creates a seal around the drill string (not shown). Seal sleeve 930 may include one or more sealing elements.

Figure 9B:
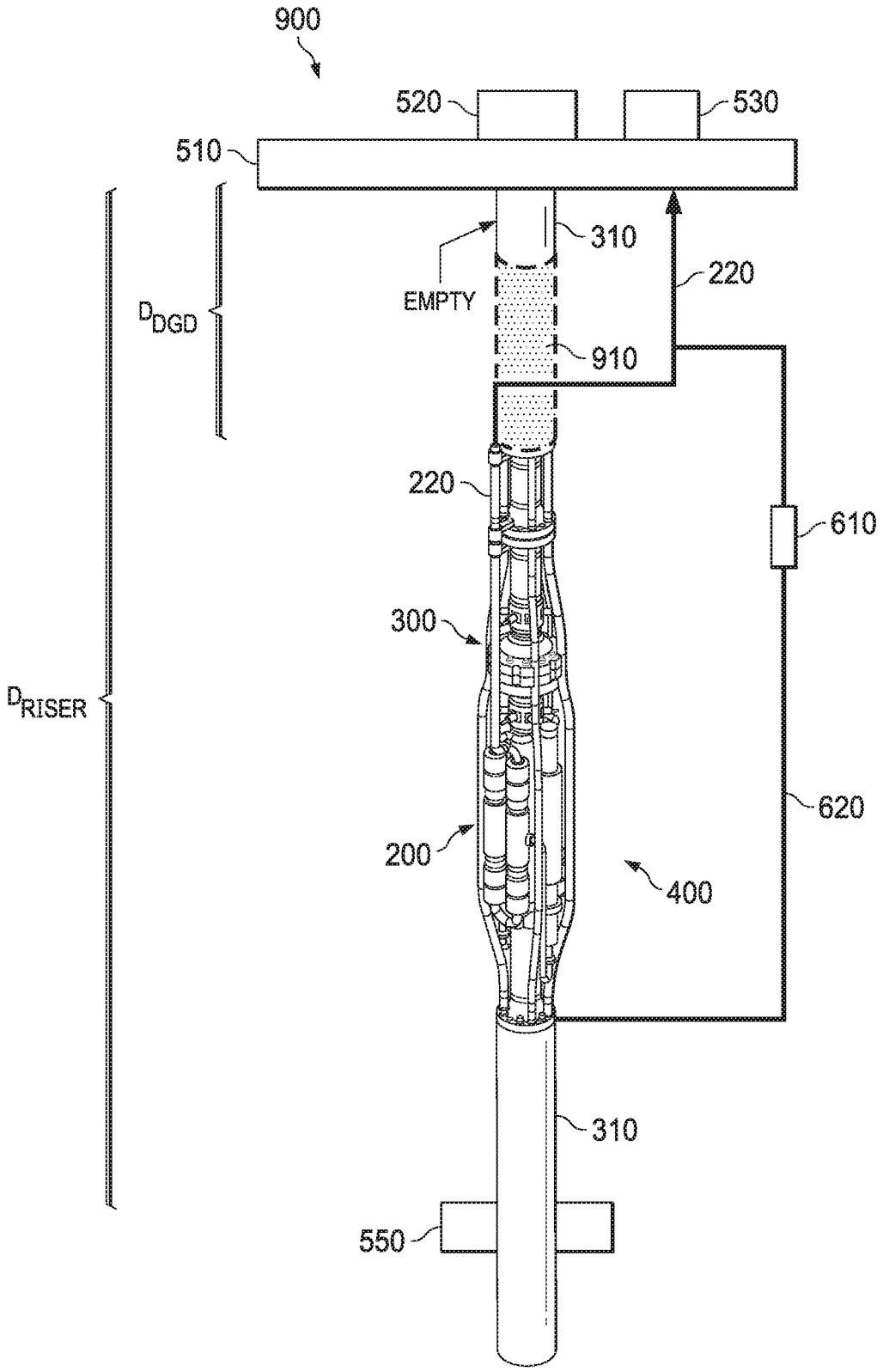
FIG. 9B shows a mid-riser configuration of a dual gradient drilling system with independent mud return line, bypass riser injection system, and controlled pressure differential across the sealing element of the active control device in accordance with one or more embodiments of the present invention.

FIG. 9B shows a mid-riser configuration 900 of DGD system with independent mud return line 400, bypass riser injection system 610, 620, and a controlled pressure differential across the sealing element of active control device 300 in accordance with one or more embodiments of the present invention. After deploying DGD system 400, the mud weights in the drilling program may change. As a consequence, there may be a benefit to having a significant pressure differential across the sealing element (not shown) of annular sealing system 300 to execute DGD operations. For example, if 16 ppg mud is required, pump system 200 may be installed at 4,800 feet seawater depth ($D_{DGD}$) on a 10,000 foot depth ($D_{RISER}$) marine riser 310, such that DGD may be achieved with at or near zero pressure differential across the sealing element (not shown) of annular sealing system 300. However, after deployment of pump system 200, the drilling mud weight may be required to change due to a change in a drilling program, for example, a change from 16 ppg to 15.5 ppg mud weight. In this case, there would need to be approximately 140 psi of pressure differential across the sealing element (not shown) of annular sealing system 300 in order for the system to achieve DGD. Such a pressure difference may not be significant enough to prevent DGD operations. The pressure differential may thereafter be reduced back to at or near zero. In doing so, the operating life of the sealing element (not shown) of annular sealing system 300 may be extended as well as maintaining a secondary pressure control barrier in place.

In certain embodiments, the operating life of the sealing element of annular sealing system 300 may be extended by reducing or eliminating the pressure differential across the sealing element. The pressure differential across the sealing element (not shown) of annular sealing system 300 may be offset using the same density drilling mud as used to drill the well by filling a portion 910 of the voided area of marine riser 310 disposed above annular sealing system 300 until the hydrostatic pressure above the sealing element is equal to the inlet pressure of pump system 200, e.g., about 140 psi in the example above. The drilling mud in the upper section of marine riser 310 is not in pressure communication with the lower section of marine riser 310 or the wellbore (not shown) disposed below it. The drilling mud may be delivered to the upper section of marine riser 310 by top filling the marine riser, which is known the industry. It should be noted that, when active control device 300 is deactivated, there may be fluid communication between the upper section of riser 310 and the lower section of riser 310 that enables drilling mud to flow from the lower section of riser 310 to the upper section of riser 310. Active control device 300 may be deactivated by relaxing annular packer 910, which disengages the sealing element of seal sleeve 930.

Figure 10:
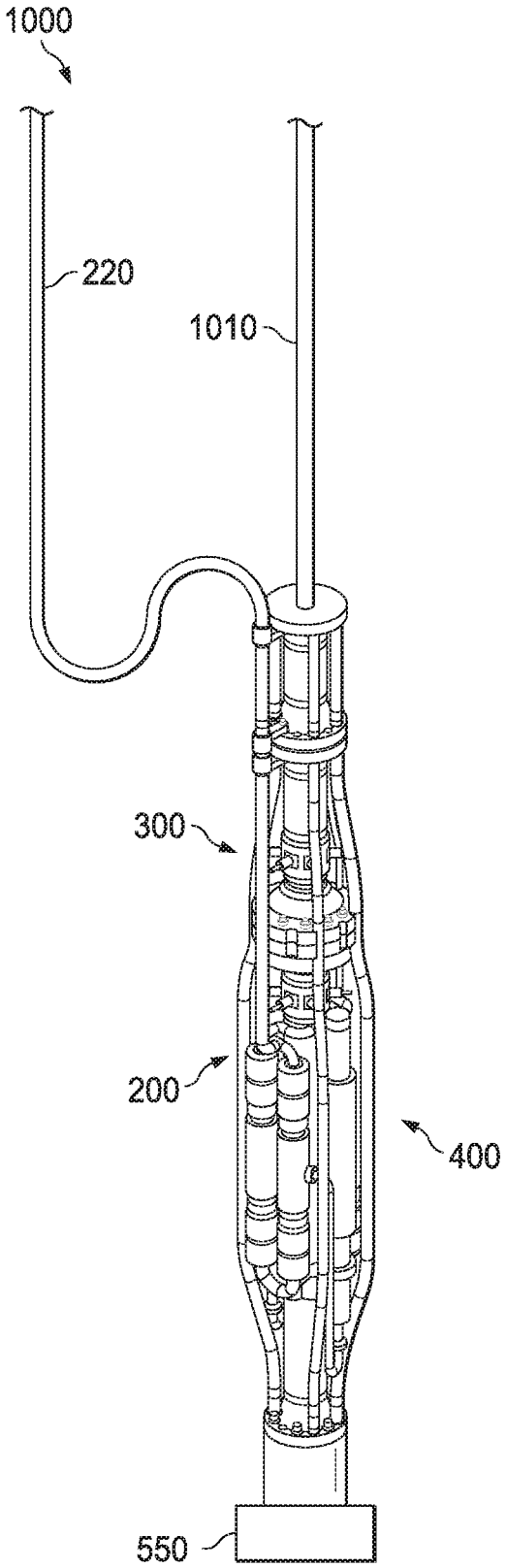
FIG. 10 shows a riser-less seafloor configuration of a dual gradient drilling system with independent mud return line disposed at or near the seafloor in accordance with one or more embodiments of the present invention.

Previously disclosed embodiments of DGD system 400 may be configured for operation without a marine riser. FIG. 10 shows a riser-less seafloor configuration 1000 of a DGD system with independent mud return line 400 disposed at or near the seafloor in accordance with one or more embodiments of the present invention. In certain embodiments of the present invention, a riser-less seafloor configuration 1000 may include a SSBOP 550 disposed above a wellhead (not shown) at or near the seafloor. In certain embodiments, the depth may be in a range between 7,500 feet and 10,000 feet or more. SSBOP 550 may include a central lumen configured to provide access to a wellbore (not shown) drilled in to the subsea surface of the Earth. A closed-hydraulic positive displacement subsea pump system 200 may fluidly connect to the central lumen of the SSBOP 550 and the wellbore (not shown). An annular sealing system 300 may fluidly connect above the closed-hydraulic positive displacement subsea pump system. A drill string 1010 may, without a marine riser, traverse the seawater depth, and pass through a central lumen of DGD system 400. An independent mud return line 220 may traverse the seawater depth and fluidly connect to a choke manifold (not shown) disposed on a platform on the surface of the sea. All other functionality, as well as optional configurations, are similar to previously disclosed embodiments except there is no marine riser in this configuration 1000.

Figure 11:
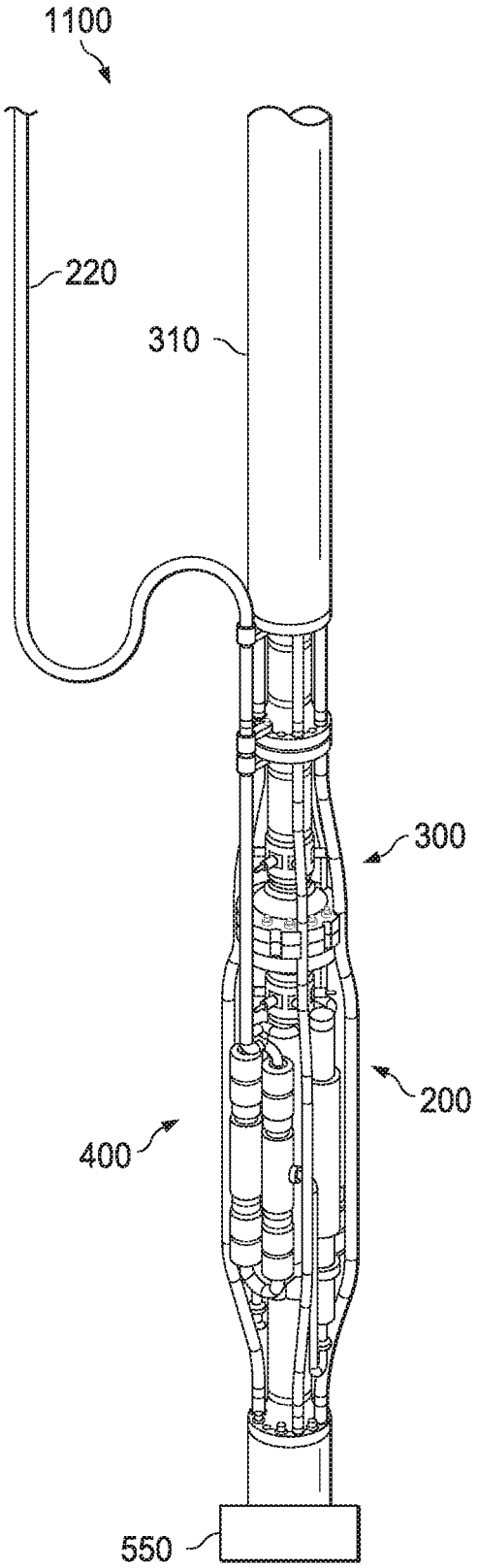
FIG. 11 shows a seafloor configuration of a dual gradient drilling system with independent mud return line disposed at or near the seafloor in accordance with one or more embodiments of the present invention.

FIG. 11 shows a seafloor configuration 1100 of a DGD system with independent mud return line 400 disposed at or near the seafloor in accordance with one or more embodiments of the present invention. Seafloor configuration 1100 is substantially identical to mid-riser configuration 500 of FIG. 5, except the lower section of the marine riser 310 of FIG. 5 is removed and DGD system 400 is disposed directly or very nearly directly over SSBOP 550. All other functionality, as well as optional configurations, are similar to previously disclosed embodiments except there is no marine riser disposed below DGD system 400.

Figure 12:
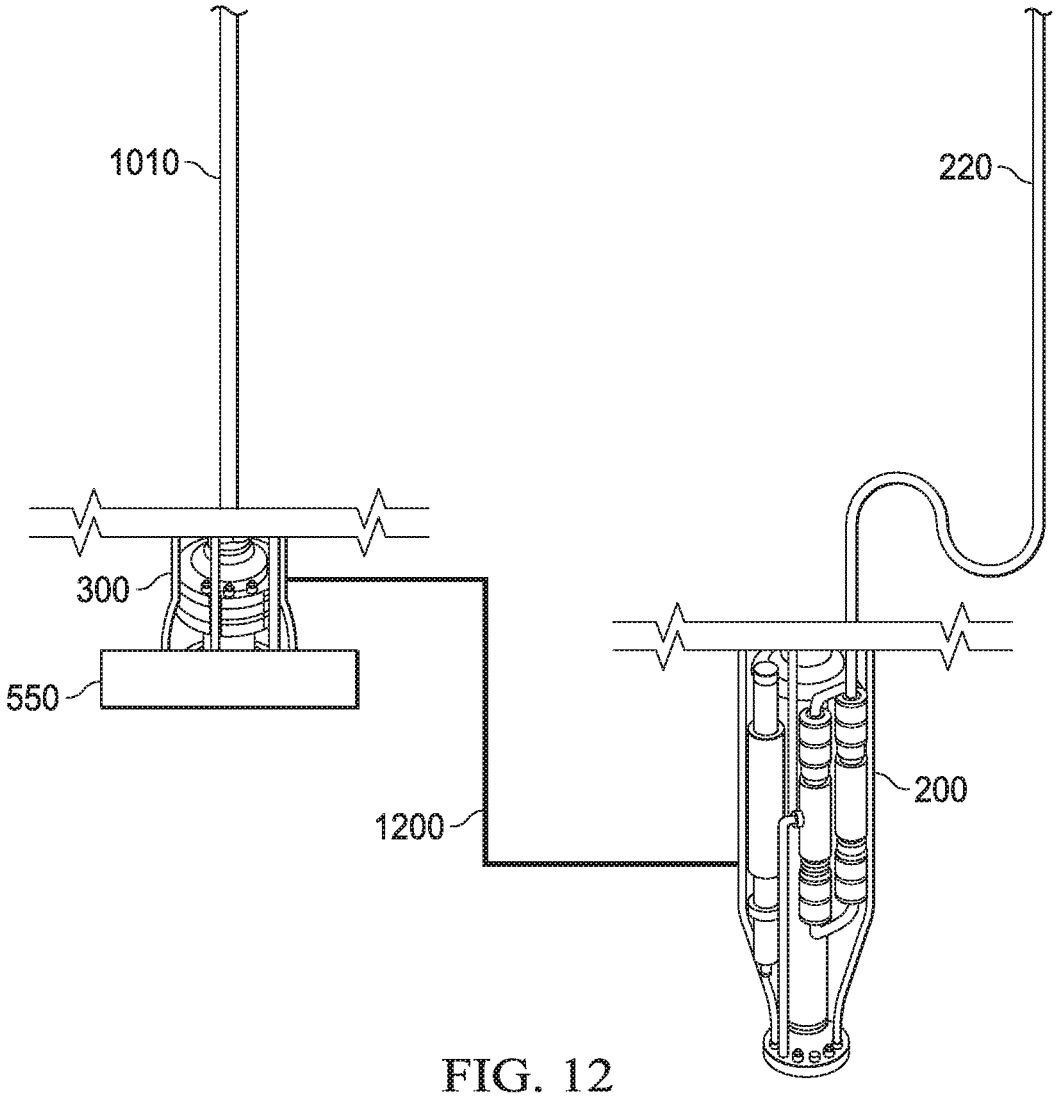
FIG. 12 shows distributed riser-less seafloor configuration of a dual gradient drilling system with independent mud return line disposed at or near the seafloor in accordance with one or more embodiments of the present invention.

FIG. 12 shows distributed riser-less seafloor configuration 1200 of a dual gradient drilling system with independent mud return line disposed at or near the seafloor in accordance with one or more embodiments of the present invention. In a distributed riser-less seafloor configuration, an annular sealing system 300 may be disposed directly or very nearly directly over SSBOP 550. A closed-hydraulic positive displacement subsea pump system 200 may be disposed elsewhere, with a fluid flow line diverting wellbore fluids to the pumps of closed-hydraulic positive displacement subsea pump system 200. An independent mud return line 220 may traverse the seawater depth and fluidly connect to a choke manifold (not shown) disposed on a platform (not shown) of the drilling rig (not shown). All other functionality, as well as optional configurations, and applicable methods are similar to previously disclosed embodiments with the exception that there is no riser in this configuration.

Figure 13:
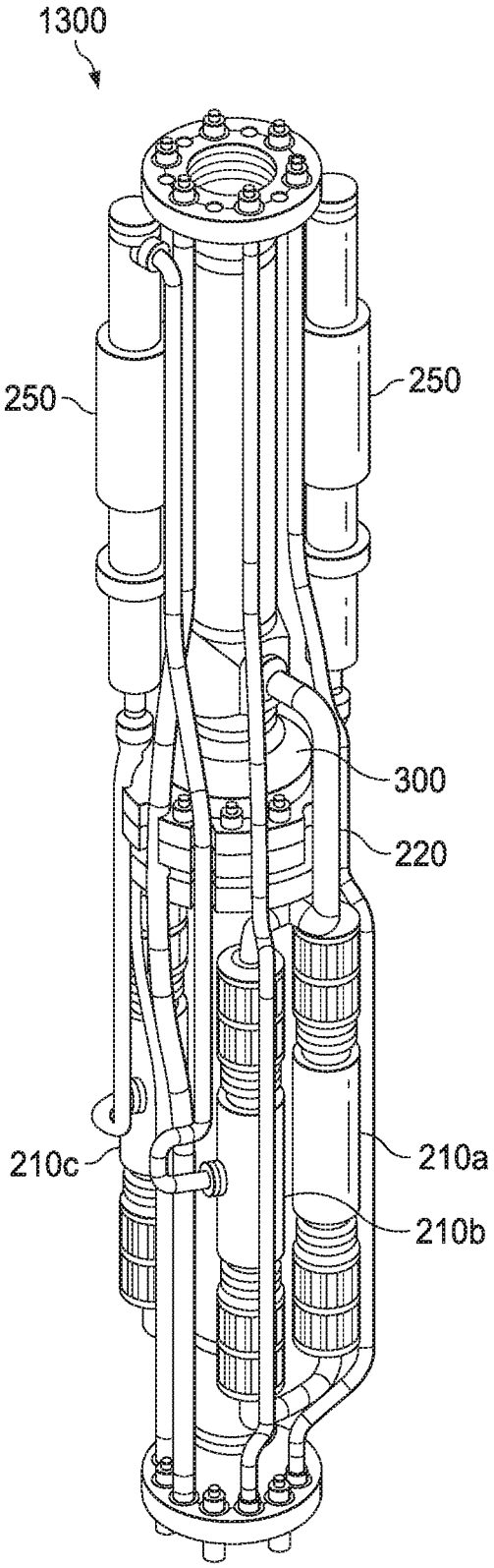
FIG. 13 shows a dual gradient drilling system with upper riser discharge line in accordance with one or more embodiments of the present invention.

FIG. 13 shows a perspective view of a DGD system with upper riser discharge line 1300 in accordance with one or more embodiments of the present invention. DGD system 1300 may include a closed-hydraulic positive displacement subsea pump system 200, an annular sealing system 300, an upper riser discharge line 220, and may optionally include an adapter (not shown), that may together serve as an integrated riser joint capable of being deployed as part of a marine riser (not shown) system. Closed-hydraulic positive displacement subsea pump system 200 may include a pair of pump heads 210*a*, 210*b* that are driven by an independent linear drive motor 250. One of ordinary skill in the art will recognize that one or more pairs of pump heads 210*a*, 210*b* and associated linear drive motor 250 may be used to smooth out the flow rate from the subsea pumps in accordance with one or more embodiments of the present invention. Upper riser discharge line 220 may fluidly connect the outlet port of each pump head to a location above the sealing element (not independently illustrated) of annular sealing system 300. In contrast to previous embodiments, instead of an independent mud return line, DGD system 1300 includes an upper riser discharge line 220 that fluidly connects pump system 200 with a top side of the sealing element (not shown) of annular sealing system 300. Annular sealing system 300 may be an active control device, a rotating control device (not shown), or other annular packer or sealing device (not shown) capable of sealing the annulus surrounding the drill string (not shown). Annular sealing system 300 may include one or more sealing elements that seal the annulus surrounding the drill string (not shown) disposed through a central lumen of DGD system 1300. All other functionality, as well as optional configurations, are similar to previously disclosed embodiments.

Figure 14:
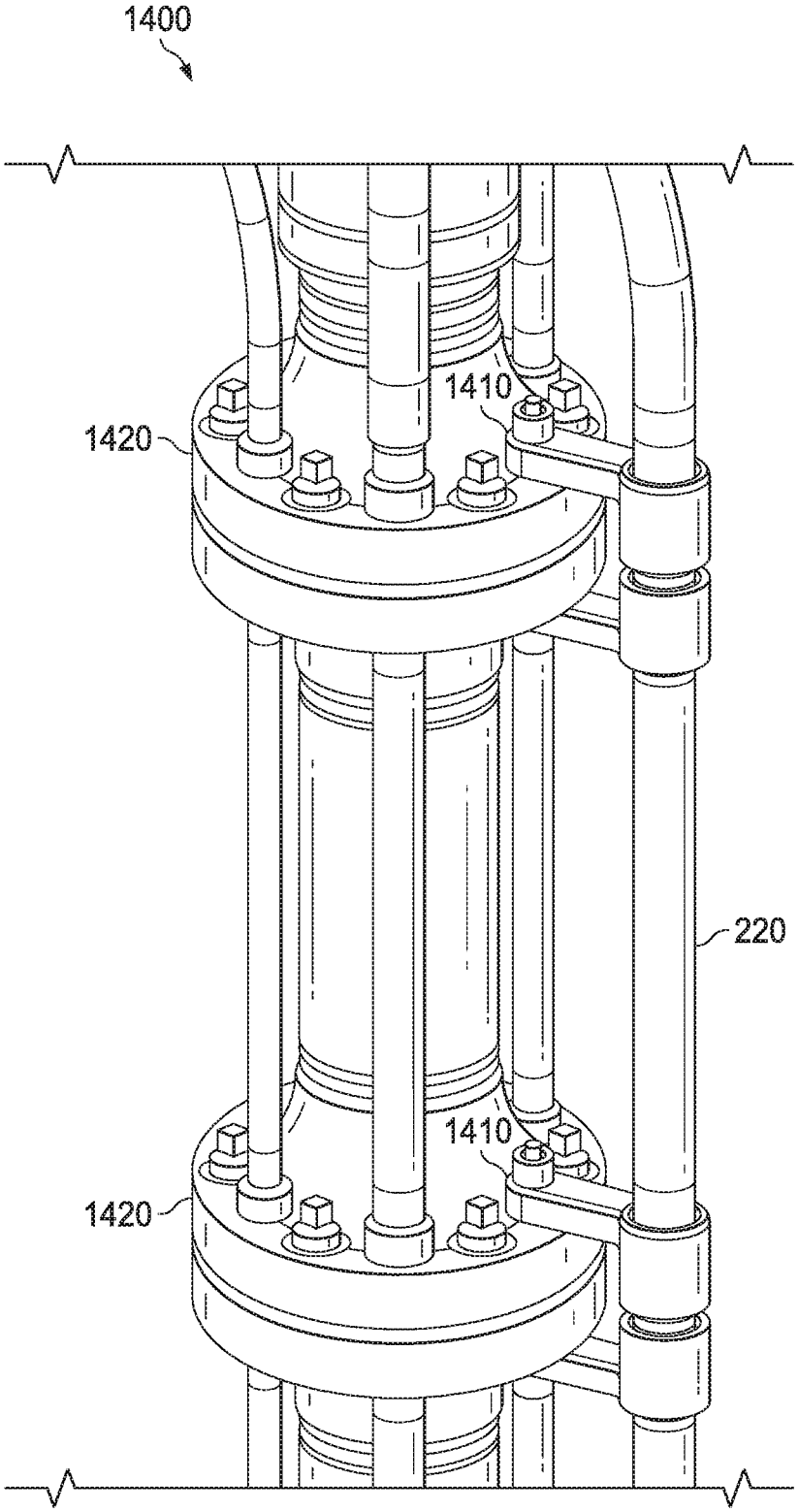
FIG. 14 shows a connection of an independent mud return line to an open port that exists in all conventional riser flanges in accordance with one or more embodiments of the present invention.

FIG. 14 shows a connection 1410 of an independent mud return line 220 to an open port that exists in all conventional riser flanges 1420 in accordance with one or more embodiments of the present invention. Connection 1410 may be a clamp that clamps on to bolted flanges 1420 or a bolted clamp that uses a spare or auxiliary port of bolted flanges 1420 to secure independent mud return line 220 to a riser joint. One of ordinary skill in the art will recognize that connection 1410 may vary based on an application or design in accordance with one or more embodiments of the present invention.

Figure 15:
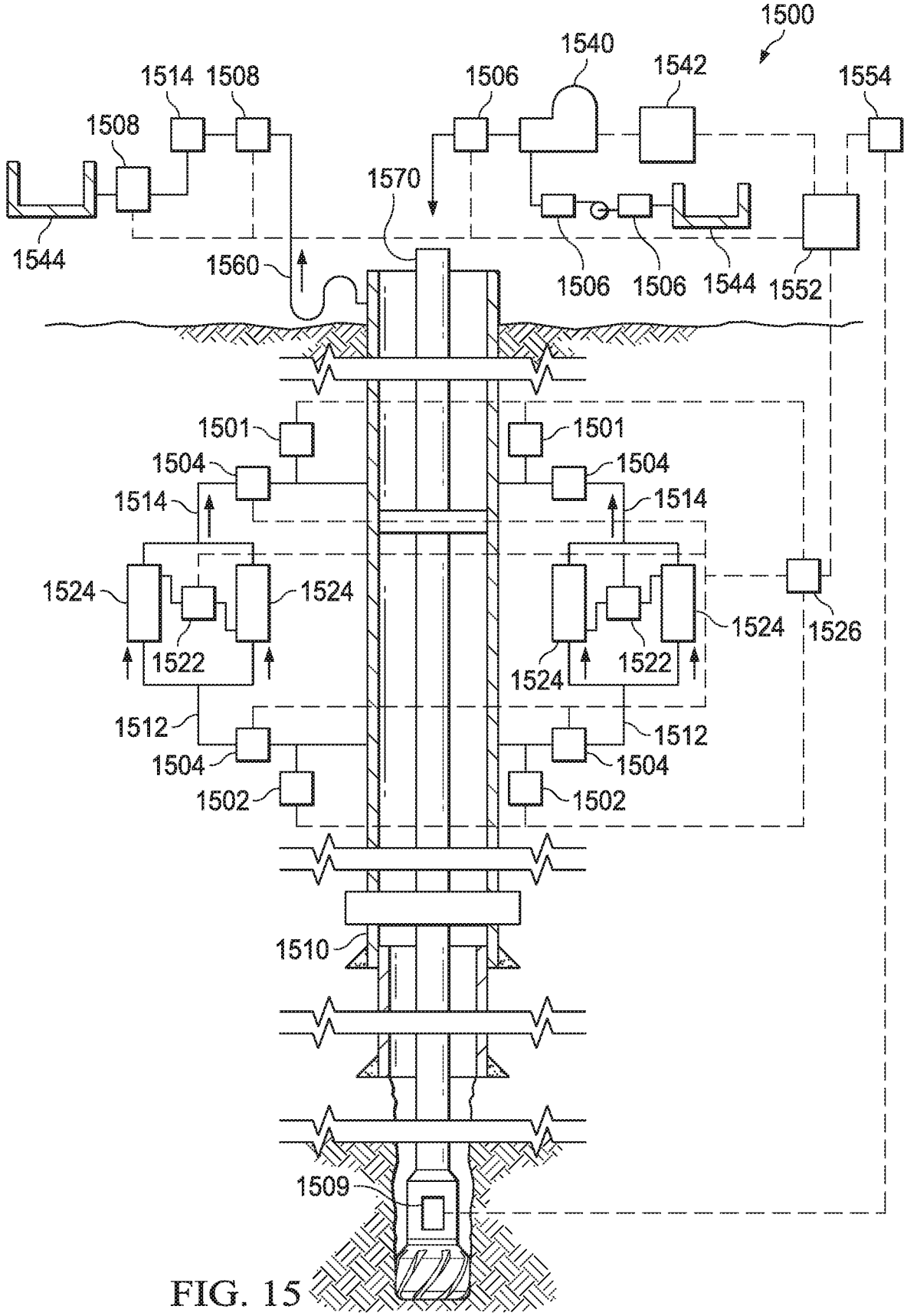
FIG. 15 shows exemplary control features of a dual gradient drilling system in accordance with one or more embodiments of the present invention.

FIG. 15 shows exemplary control features of a DGD system 1500 in accordance with one or more embodiments of the present invention. While DGD system 1500 is exemplary, the following may apply to all disclosed embodiments. In one or more embodiments of the present invention, pressure transmitters may be disposed on the inlet ports of the subsea pumps to monitor the inlet pressure of the subsea pumps. A change in pressure at the inlet ports directly reflects a change of pressure in the wellbore.

Similarly, in one or more embodiments of the present invention, mass flow meters may be positioned at the inlet ports of the subsea pumps and on the discharge side of any pump used to inject fluids into the wellbore. Pump speed adjustments may be made to ensure a constant wellbore pressure by ensuring the mass flow into the wellbore equals the mass flow out of the wellbore. Additionally, the mass flow meter reading may be used to adjust pump speed in order to add or remove an amount of mass from the wellbore system to achieve a desired change in wellbore pressure. The correlation between a change in mass and its actual change in wellbore pressure may be calculated by a hydraulics model or understood by wellbore finger printing performed periodically. Ultimately, the pressure while drilling device on the bottom hole assembly or pressure transmitters on the subsea pump inlets may confirm that a target wellbore pressure adjustment may be reached. It is important to note that a mass flow meter may also be placed on the discharge side of the subsea pump system as it would provide the same benefits of measuring mass flow out of the annulus.

Additionally, changes in wellbore pressure do not necessarily only need to be induced by changes in the speed of the subsea pumps. The pump speed of the rig's injection pumps, such as the mud pumps or riser booster line pump may also be manipulated. In either case, the operating philosophy remains the same; the mass stored in the wellbore is manipulated by changing pump speed and inducing a delta between mass flow in and mass flow out. There is also an alternative option to increase the precision of wellbore pressure adjustments, which involves installation and use of a high precision mud pump that is lined up to inject drilling fluid into the wellbore along with the other typical injection side pumps. Such a pump is typically designed for high pressure and low volumes.

Returning to the figure, the subsea pump system may use signals from one or more pressure sensor/transmitters 1502 on suction headers 1512. Pressure sensor/transmitters 1502 may not be limited to placement on suction headers 1512 and need only be in fluid communication with the wellbore annulus upstream of the subsea pump. Pressure sensor/transmitters 1502 may be connected to a surface or subsea pump controller 1526. Pump controller 1526 may determine the speed of linear drive motors 1522 and therefore the volumetric flow rate of pump heads 1524. If the mass flow into the well from the mud pump 1540 equals the mass flow out of the well, the pressure reading at the suction headers 1512 and thus, the wellbore pressure, will remain constant. If the mass flow into the well is greater than the mass flow out, the pressure reading at the suction headers 1512 and thus, the wellbore pressure will be increased up to the point the fluid pressure gradient resembles that of a conventional drilling operation. If the mass flow into the well is less than the mass flow out, the pressure reading at the suction headers 1512 will be reduced up to the point the suction pressure goes to zero. Furthermore, wellbore pressure will drop accordingly.

In addition to pressure sensors 1502, system 1500 may use additional signals from one or more subsea flow sensors 1504 measuring mass and volumetric flow on suction headers 1512. Subsea flow sensors 1504 may, for example, be a Coriolis meter. Subsea flow sensors 1504 may be used to measure the flow out of a defined well volume which consists of all components fluidly connected to the wellbore, including the inside of the drill string and related surface piping. In addition, one or more surface flow sensors 1506 may measure mass and volumetric flow into the defined well volume, which consists of all components fluidly connected to the wellbore. In addition, return surface flow sensors 1508 may measure mass and volumetric flow to verify readings from the other flow sensors. A choke 1514 may be used to quickly affect backpressure if desired. Pressure transmitters 1502 and flow sensors 1504, 1506, and 1508 may be connected to surface or subsea pump controller 1526 and DGD system data acquisition apparatus 1552. The pressure reading from pressure transmitters 1502 and the flow reading from the subsea flow sensors 1504 and surface flow sensors 1506, 1508 may be used to measure the mass in the system 1500. The mass balanced may be tracked and used as an indicator of expected pressure. If the mass from the well is being depleted, i.e., the mass flow into the well is less than the mass flow out, the pressure reading will decrease up to the point the suction pressure goes to zero. If mass is accumulating in the well, i.e., the mass flow into the well is greater than the mass flow out, the pressure reading will be increased up to the point the fluid pressure gradient resembles that of conventional drilling operations. If the mass in the well is constant, the pressure reading will remain the same.

In certain embodiments, a volumetric flow meter (not shown) may be used in combination with a hydraulics model that may convert the volumetric flow rate into a mass flow rate. The volumetric flow meter (not shown), may be, for example, a wedge meter. System 1500 may further include a mud pump controller 1542, mud pits 1544, pressure-while-drilling surface data processor 1554, pressure-while-drilling downhole sensor 1509, return flow hoses 1560, riser 1510, drill string 1570, discharge header 1514, and discharge pressure transmitter 1501.

An individual, such as an operator, may determine that the target volume of mud above the sealing element has been reached via monitoring the flow of the pump delivering mud to the upper riser section or by monitoring the pressure reading on a pressure transmitter installed just above the sealing element. Even when this control option is implemented, wellbore pressure may be controlled by managing the amount of mass in the drilling riser and the wellbore. As such, wellbore pressure is not controlled by adjusting the height of the drilling mud in the riser. IN embodiments employing check valve assemblies in the subsea module, or in other locations such as the marine riser, and flow stop valves, a sealing element sleeve that was operating with zero differential pressure and an empty upper riser section may be replaced as needed without disrupting the DGD effect on the wellbore. Such replacement may be accomplished by shutting down the rig pumps and subsea pump while the check valve assemblies prevent annulus u-tubing and the flow stop valves prevent booster line and drill string u-tubing. Once the well is in a steady state, the seal sleeve may simply be removed and replaced. If there is a volume of drilling mud above the sealing element, then that volume of mud will maintain the DGD effect while the sealing element is replaced. If the sealing element is holding pressure from below and there is no mud in the upper riser section, the above steps may be supplemented with the closure of a riser annular below the sealing element. The riser annular may be closed at any time as a precautionary measure.

In one or more embodiments of the present invention, a method of dual gradient drilling may include sealing an annulus surrounding a drill string, pumping drilling fluids down the drill string, using a closed-hydraulic positive displacement subsea pump system to pump returning fluids toward a rig, and controlling inlet pressure of one or more subsea pumps by managing an amount of mass stored in a marine riser, if any, and a wellbore disposed below the closed-hydraulic positive displacement subsea pump system without venting hydraulic drive fluid. The amount of mass stored may be managed by adjusting a pump speed of the closed-hydraulic positive displacement subsea pump system until a target pressure set point is achieved and then setting the pump speed to match an injection rate into the wellbore such that mass out is approximately equal to mass being injected into the wellbore.

In certain embodiments, the method may further include one or more of sensing the inlet pressure of one or more subsea pumps of the subsea pump system, sensing annular pressure, sensing volumetric flow and modeling an amount of mass being injected into the annuls via the drill string, sensing volumetric flow and modeling an amount of mass being discharged from the annulus, using a hydraulic model to determine an amount of mass stored required to achieve a target inlet pressure of one or more subsea pumps, maintaining the pump speed and adjusting inlet pressure by adjusting injection rate down the drill string or booster line or by installing and adjusting an injection rate of a dedicated high precision pump not typically used during drilling operations, and disposing fluids in an upper section of a marine riser disposed above an annular sealing element until a target pressure differential across the annulus sealing element is achieved.

The methods disclosed herein may be applied to all disclosed embodiments and configurations of DGD systems including those where the DGD system is disposed at a shallower installation depth, at mid-riser level, and on or near the seafloor.

Advantages of one or more embodiments of the present invention may include one or more of the following:

In one or more embodiments of the present invention, a system and method of DGD may include a closed-hydraulic positive displacement subsea pump system that may have a subsea installation depth on the riser from shallow to mid-riser or may be disposed on or near the seafloor, with or without a riser.

In one or more embodiments of the present invention, a system and method of DGD may include a closed-hydraulic positive displacement subsea pump system that includes a closed hydraulic system that does not vent hydraulic drive fluid into the sea or expose dynamic seals to drilling fluids.

In one or more embodiments of the present invention, a system and method of DGD may include a closed-hydraulic positive displacement subsea pump system where the inlet pressure of the subsea pumps may be at or near zero psi, thereby allowing the DGD system to reduce riser and/or wellbore pressure down to seawater pressure at the mudline with a much shallower installation depth than an open hydraulic system would otherwise be able to achieve.

In one or more embodiments of the present invention, a system and method of DGD may include a closed-hydraulic positive displacement subsea pump system where the inlet pressure of the subsea pumps may be controlled by one or more methods disclosed herein that do not require adjustment of the mud level in the marine riser, if any, or the venting of hydraulic drive fluid into the sea.

In one or more embodiments of the present invention, a system and method of DGD may include a closed-hydraulic positive displacement subsea pump system that includes a linear drive motor that uses dual-sided piston rod that does not lose synchronization. The piston faces are always 180 degrees phase shift as required to provide the smoothest possible flow.

In one or more embodiments of the present invention, a system and method of DGD, the riser sections, if any, disposed above the annular sealing system may be voided and riser sections, if any, disposed below the closed-hydraulic positive displacement subsea pump system may be full. Methods disclosed herein allow for the control of the inlet pressure of the subsea pumps as well as wellbore pressure by modulating the speed of the subsea pumps rather than adjusting the mud level in the marine riser.

In one or more embodiments of the present invention, a system and method of DGD, the DGD system may operate with little to no differential pressure across the sealing element of the annular sealing system, even when the target inlet pressure of the subsea pumps is greater than zero. This may be achieved by filling a portion of the riser section above the annular sealing system with drilling mud until the hydrostatic pressure exerted by the fluids in the upper riser section(s) is equal to or slightly less than the target inlet pressure of the subsea pumps. By operating the system with zero or near zero differential across the sealing element of the annular sealing system, the sealing element life may be extended while having the benefit of establishing a barrier column of fluid above. Even when the system is operated with a fluid level above the sealing element, the wellbore pressure may be controlled by methods disclosed herein, rather than by adjusting the riser level or venting hydraulic drive fluid.

In one or more embodiments of the present invention, a system and method of DGD, a pressure differential across the sealing element of the annular sealing system may be controlled to extend the operational life of the sealing element. While the riser section or sections disposed above the annular sealing system are typically voided in embodiments disclosed herein, fluids may be disposed in a portion of the voided riser sections above the sealing element of the annular sealing system to reduce the pressure differential across the sealing element to zero or near zero psi.

In one or more embodiments of the present invention, a system and method of DGD may provide riser gas handling capability that directs gas to a mud-gas-separator that may be disposed on a floating platform of a drilling rig.

In one or more embodiments of the present invention, a system and method of DGD may include a closed-hydraulic positive displacement pump system and annular sealing system installed on a riser system with a tie-in to an independent mud return line that leads to a choke manifold and an optional bypass riser injection system for rapid conversion to FMCD and PMCD operations. As such, the DGD system may be rapidly converted to facilitate conventional drilling, MPD, DGD, ASBP-MPD, PMCD, or FMCD operations.

In one or more embodiments of the present invention, a system and method of DGD allows a closed-hydraulic positive displacement subsea pump system to be disposed at shallow or mid-riser depth rather than at the seafloor. Such configurations provide a number of cost and operational advantages. The shallow or mid-riser installation depth reduces the number of riser joints required above the subsea pump system that must be modified with an independent mud return line, reduces the cost of hydraulic and electrical umbilicals, and reduces trip time required to swap out the sealing element of an annular sealing system. In addition, having a number of riser joints disposed below such a DGD system provides a substantial amount of riser volume which may act to dampen pressure oscillations caused by the pump system before reaching the wellbore.

In one or more embodiments of the present invention, a system and method of DGD allows a closed-hydraulic positive displacement subsea pump system to be disposed at or near the seafloor to obtain other advantages. For example, when positioned at or near the sea floor, the DGD system may more easily operate with or without riser segments, increasing cost savings for certain applications.

In one or more embodiments of the present invention, a system and method of DGD may use a single fluid for all DGD operations.

While the present invention has been described with respect to the above-noted embodiments, those skilled in the art, having the benefit of this disclosure, will recognize that other embodiments may be devised that are within the scope of the invention as disclosed herein. Accordingly, the scope of the invention should be limited only by the appended claims.

What is claimed is:

1. A distributed riser-less dual gradient drilling system comprising:

a subsea blowout preventer disposed above a wellhead, the subsea blowout preventer comprising a central lumen configured to provide access to a wellbore;

an annular sealing system fluidly connected to the subsea blowout preventer;

a closed-hydraulic positive displacement subsea pump system fluidly connected to a fluid diversion port of the annular sealing system; and an independent mud return line fluidly connecting one or more pump heads of the closed-hydraulic positive displacement subsea pump system to a rig without use of an additional pump system, wherein a pump speed of the closed-hydraulic positive displacement subsea pump system is adjusted to achieve a target amount of fluid mass in a fluidly connected system upstream of the closed-hydraulic positive displacement subsea pump to achieve a target inlet pressure of the closed-hydraulic positive displacement subsea pump.

2. The distributed riser-less dual gradient drilling system of claim 1, further comprising:

a bypass riser injection system fluidly connected to the independent mud return line configured to bypass the annular sealing system and the closed-hydraulic positive displacement subsea pump system for injection of fluids into the wellbore in total loss drilling conditions.

3. The distributed riser-less dual gradient drilling system of claim 1, further comprising:

an anti-u-tubing flow stop valve disposed on the drill string.

4. The distributed riser-less dual gradient drilling system of claim 1, further comprising:

an annular packer or sealing device disposed before the closed-hydraulic positive displacement subsea pump system.

5. The distributed riser-less dual gradient drilling system of claim 1, wherein the closed-hydraulic positive displacement subsea pump system comprises a first pump head, an independent linear drive motor, and a second pump head.

6. The distributed riser-less dual gradient drilling system of claim 5, wherein each of the first pump head and the second pump head comprise an inlet port, a bottom check valve assembly, a fluid cavity disposed between pressure balanced liners, a top check valve assembly, and an outlet port.

7. The distributed riser-less dual gradient drilling system of claim 5, wherein the independent linear drive motor comprises a reciprocating piston having a first piston face and a second piston face that is electronically actuated to compress or uncompress a hydraulic drive fluid in a closed-hydraulic system.

8. The distributed riser-less dual gradient drilling system of claim 1, wherein the closed-hydraulic positive displacement subsea pump system comprises a hydraulic drive fluid that is wholly contained by the pump system and is not vented into a sea.

9. The distributed riser-less dual gradient drilling system of claim 6, wherein the pressure balanced liners isolate drilling fluids from hydraulic drive fluid.

10. The distributed riser-less dual gradient drilling system of claim 1, wherein the closed-hydraulic positive displacement subsea pump system does not include dynamic seals exposed to drilling fluids.

11. The distributed riser-less dual gradient drilling system of claim 1, wherein the annular sealing system comprises an active control device, a rotating control device, or an annular seal configured to seal an annulus surrounding a drill string disposed therethrough.

12. The distributed riser-less dual gradient drilling system of claim 1, wherein the annular sealing system comprises one or more sealing elements.

13. The distributed riser-less dual gradient drilling system of claim 1, wherein dual gradient drilling operations are conducted with continuous circulation.

14. The distributed riser-less dual gradient drilling system of claim 1, wherein gas in the wellbore is controlled by the annular sealing system and diversion of riser fluids through the independent mud return line to a choke manifold and a mud-gas-separator disposed on the floating platform of the rig.

* * * * *